US007335043B2

(12) United States Patent
Ngo et al.

(10) Patent No.: US 7,335,043 B2
(45) Date of Patent: Feb. 26, 2008

(54) ELECTRICAL POWER CONTACTS AND CONNECTORS COMPRISING SAME

(75) Inventors: Hung Viet Ngo, Harrisburg, PA (US); Christopher G. Daily, Harrisburg, PA (US); Wilfred J. Swain, Mechanicsburg, PA (US); Stuart C. Stoner, Lewisberry, PA (US); Christopher J. Kolivoski, York, PA (US); Douglas M. Johnescu, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/450,494

(22) Filed: Jun. 9, 2006

(65) Prior Publication Data

US 2006/0281354 A1 Dec. 14, 2006

Related U.S. Application Data

(63) Continuation-in-part of application No. 11/019,777, filed on Dec. 21, 2004, now Pat. No. 7,258,562.

(60) Provisional application No. 60/533,822, filed on Dec. 31, 2003, provisional application No. 60/533,749, filed on Dec. 31, 2003, provisional application No. 60/533,750, filed on Dec. 31, 2003, provisional application No. 60/534,809, filed on Jan. 7, 2004, provisional application No. 60/545,065, filed on Feb. 17, 2004.

(51) Int. Cl.
*H01R 13/53* (2006.01)

(52) U.S. Cl. ..... 439/290; 439/857

(58) Field of Classification Search ..... 439/290, 439/857, 284, 287, 295, 291
See application file for complete search history.

(56) References Cited

U.S. PATENT DOCUMENTS

| | | | | |
|---|---|---|---|---|
| 318,186 | A | 5/1885 | Hertzog | |
| 741,052 | A | 10/1903 | Mahon | |
| 3,011,143 | A | 11/1961 | Dean | 339/49 |
| 3,178,669 | A | 4/1965 | Roberts | 339/49 |
| 3,208,030 | A | 9/1965 | Evans et al. | |
| 3,411,127 | A | 11/1968 | Adams | 339/47 |
| 3,514,740 | A | 5/1970 | Filson | 439/290 |
| 3,634,811 | A | 1/1972 | Teagno et al. | 439/290 |
| 3,845,451 | A | 10/1974 | Neidecker | 339/49 |
| 3,972,580 | A | 8/1976 | Pemberton et al. | 339/47 |

(Continued)

OTHER PUBLICATIONS

In The United States Patent and Trademark Office, Office Action Summary of U.S. Appl. No. 11/441,856 dated Jun. 13, 2007, 18 pages.

(Continued)

*Primary Examiner*—Gary F. Paumen
(74) *Attorney, Agent, or Firm*—Woodcock Washburn LLP

(57) ABSTRACT

Preferred embodiments of power contacts include two or more opposing contact beams of a first type that are spaced apart along at least a portion of the length thereof when the power contact is in an unmated state; and two or more opposing contact beams of a second type. The contact beams of the second type are spaced apart so that the contact beams of the second type pinch the contact beams of the first type when the power contact is mated with a mating contact, thereby causing the contact beams of the first type of deflect inwardly toward each other.

26 Claims, 25 Drawing Sheets

U.S. PATENT DOCUMENTS

| | | | | |
|---|---|---|---|---|
| 4,403,821 | A | 9/1983 | Zimmerman et al. | 339/97 |
| 4,552,425 | A | 11/1985 | Billman | 339/47 |
| 4,564,259 | A | 1/1986 | Vandame | 339/258 |
| 4,685,886 | A | 8/1987 | Denlinger et al. | 439/55 |
| 4,820,182 | A | 4/1989 | Harwath et al. | 439/290 |
| 4,963,102 | A | 10/1990 | Gettig et al. | 439/291 |
| 5,024,610 | A | 6/1991 | French et al. | 439/857 |
| 5,035,639 | A | 7/1991 | Kilpatrick et al. | 439/290 |
| 5,104,332 | A | 4/1992 | McCoy | 439/290 |
| 5,577,928 | A | 11/1996 | Duclos | 439/290 |
| 5,588,859 | A | 12/1996 | Maurice | 439/290 |
| 6,193,537 | B1 | 2/2001 | Harper, Jr. et al. | 439/291 |
| 6,319,075 | B1 | 11/2001 | Clark et al. | 439/825 |
| 6,776,635 | B2 * | 8/2004 | Blanchfield et al. | 439/181 |
| 6,848,950 | B2 | 2/2005 | Allison et al. | 439/682 |
| 6,994,569 | B2 | 2/2006 | Minich et al. | 439/79 |
| 7,070,464 | B2 * | 7/2006 | Clark et al. | 439/825 |
| 2003/0236035 | A1 * | 12/2003 | Kuroda et al. | 439/857 |
| 2006/0003620 | A1 | 1/2006 | Daily et al. | 439/295 |

OTHER PUBLICATIONS

In The United States Patent and Trademark Office, Office Action Summary of U.S. Appl. No. 11/441,856 dated Feb. 16, 2007, 12 pages.

In The United States Patent and Trademark Office, Office Action Summary of U.S. Appl. No. 11/441,856 dated Aug. 10, 2006, 10 pages.

In The United States Patent and Trademark Office, Notice of Allowance and Fee(s) Due of U.S. Appl. No. 11/408,437 dated Jan. 12, 2007, 6 pages.

In The United States Patent and Trademark Office, Office Action Summary of U.S Appl. No. 11/407,437 dated Sep. 11, 2006, 7 pages.

In The United States Patent and Trademark Office, Supplemental Notice of Allowability of U.S. Appl. No. 11/019,777dated Jul. 25, 2007, 2 pages.

In The United States Patent and Trademark Office, Notice of Allowance and Fee(s) Due of U.S. Appl. No. 11/019,777 dated Jun. 5, 2006, 7 pages.

In The United States Patent and Trademark Office, Notice of Allowance and Fee(s) Due of U.S. Appl. No. 11/019,777 dated Feb. 28, 2006, 6 pages.

In The United States Patent and Trademark Office, Office Action Summary of U.S. Appl. No. 11/019,777 dated Nov. 7, 2005, 6 pages.

* cited by examiner

FIG. 34
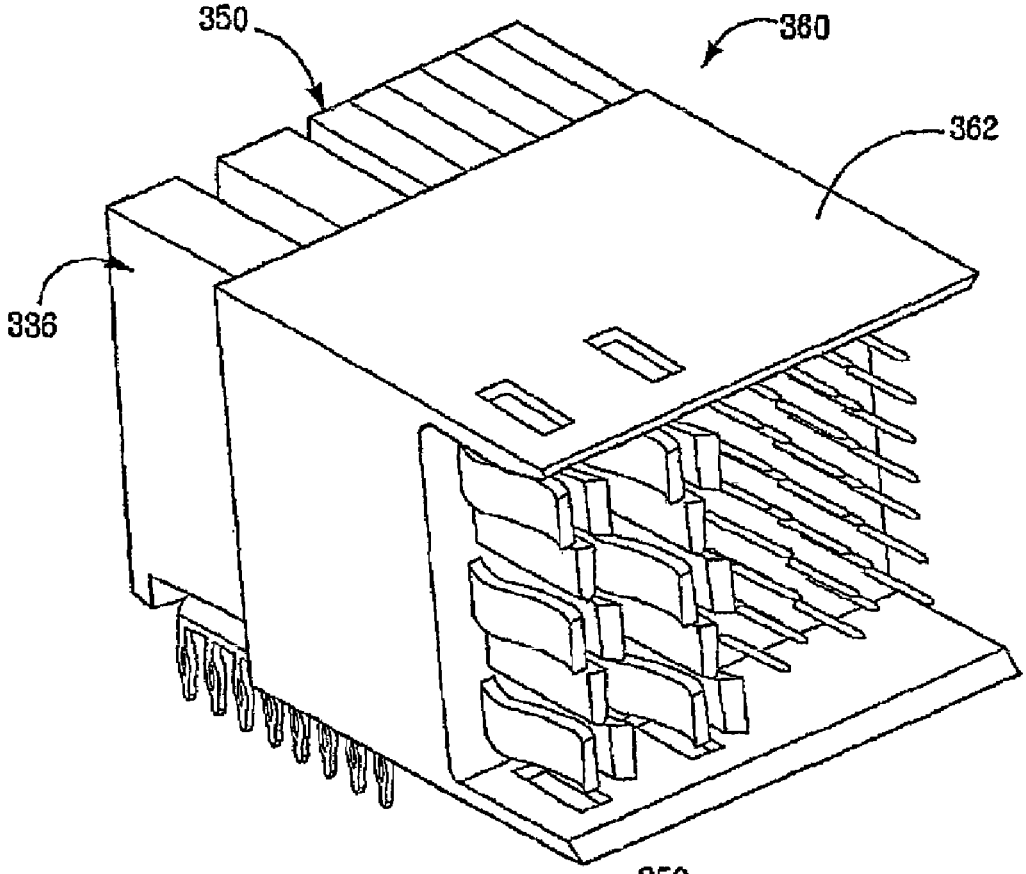
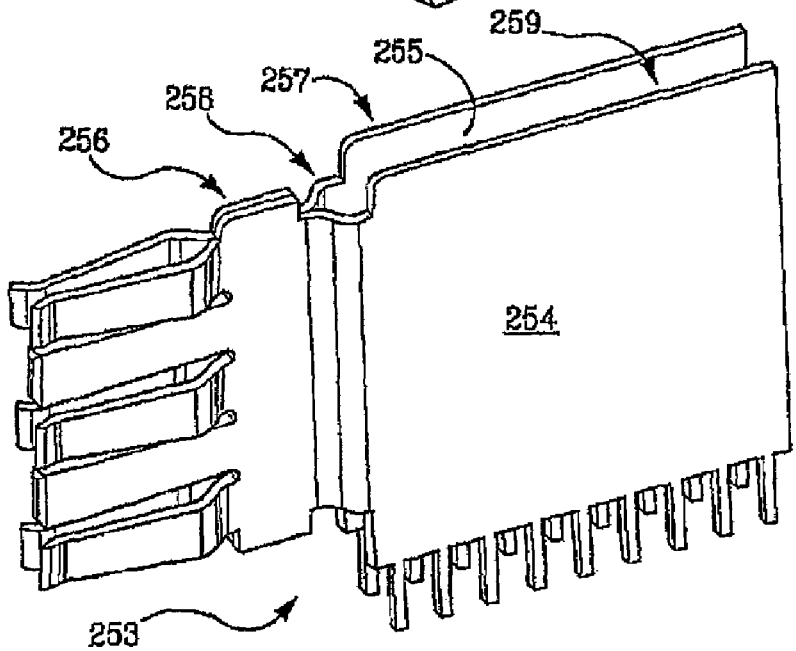
FIG. 35

ELECTRICAL POWER CONTACTS AND CONNECTORS COMPRISING SAME

CROSS REFERENCE TO RELATED APPLICATIONS

This application is a continuation in part of application Ser. No. 11/019,777, filed Dec. 21, 2004, now U.S. Pat. No. 7,258,562, which claims the benefit of U.S. Provisional Application Nos. 60/533,822, filed on Dec. 31, 2003, 60/533,749, filed Dec. 31, 2003, 60/533,750, filed Dec. 31, 2003, 60/534,809, filed Jan. 7, 2004, and 60/545,065, filed Feb. 17, 2004. This application is related to U.S. application Ser. No. 11/019,777, filed Dec. 21, 2004, now U.S. Pat. No. 7,258,562; U.S. application Ser. No. 11/408,437, filed Apr. 21, 2006, now U.S. Pat. No. 7,220,141; and U.S. application Ser. No. 11/441,856, filed May 26, 2006. The contents of each of these applications is incorporated by reference herein in its entirety.

FIELD OF THE INVENTION

The present invention relates to electrical contacts and connectors designed and configured for transmitting power. At least some of the preferred connector embodiments include both power contacts and signal contacts disposed in a housing unit.

BACKGROUND OF THE INVENTION

Electrical hardware and systems designers are confronted with competing factors in the development of new electrical connectors and power contacts. For example, increased power transmission often competes with dimensional constraints and undesirable heat buildup. Further, typical power connector and contact beam designs can create high mating forces. When a high mating force is transferred into a connector housing structure, the plastic can creep, causing dimensional changes that can affect the mechanical and electrical performance of the connector. The unique connectors and contacts provided by the present invention strive to balance the design factors that have limited prior art performance.

SUMMARY OF THE PREFERRED EMBODIMENTS

The present invention provides power contacts for use in an electrical connector. In accordance with one preferred embodiment of the present invention, there has now been provided a power contact including a first plate-like body member, and a second plate-like body member stacked against the first plate-like body member so that the first and second plate-like body members are touching one another along at least a portion of opposing body member surfaces.

In accordance with another preferred embodiment of the present invention, there has now been provided a power contact including juxtaposed first and second plate-like body members that define a combined plate width. The first body member includes a first terminal and the second body member includes a second terminal. A distance between respective distal ends of the first terminal and the second terminal is greater than the combined plate width.

In accordance with yet another preferred embodiment, there has now been provided a power contact including opposing first and second plate-like body members. A set of pinching beams extends from the opposing plate-like body members for engaging a straight beam associated with a mating power contact. At least one straight beam also extends from the opposing plate-like body members for engaging an angled beam associated with the mating power contact.

In accordance with another preferred embodiment, there has now been provided a power contact including a first plate that defines a first non-deflecting beam and a first deflectable beam, and a second plate that defines a second non-deflecting beam and a second deflectable beam. The first and second plates are positioned beside one another to form the power contact.

The present invention also provides matable power contacts. In accordance with one preferred embodiment of the present invention, there has now been provided matable power contacts including a first power contact having opposing first and second plate-like body members and a second power contact having opposing third and fourth plate-like body members. At least one of the first and second body members and the third and fourth body members are stacked against each other.

In accordance with another preferred embodiment, there has now been provided matable power contacts including a first power contact having a pair of straight beams and a pair of angled beams, and a second power contact having a second pair of straight beams and a second pair of angled beams. The pair of straight beams are in registration with the second pair of angled beams; the pair of angled beams are in registration with the second pair of straight beams.

In accordance with yet another preferred embodiment, there has now been provided matable power contacts including first and second power contacts. The first power contact includes a body member, a deflecting beam extending from the body member, and a non-deflecting beam extending from the body member. The second power contact includes a second body member, a second deflecting beam extending from the second body member, and a second non-deflecting beam extending from the second body member. When the first and second power contacts are mated, the deflecting beam engages the second non-deflecting beam, and the non-deflecting beam engages the second deflecting beam, so that mating forces are applied in opposite directions to minimize stress in each of the first and second power contacts.

In accordance with another preferred embodiment, there has now been provided matable power contacts including a first power contact and a second power contact. Each of the first and second power contacts includes a pair of opposing non-deflecting beams and a pair of opposing deflectable beams.

The present invention further provides electrical connectors. Preferred electrical connectors may include the above-described power contacts. Additionally, and in accordance with one preferred embodiment of the present invention, there has now been provided an electrical connector including a housing and a plurality of power contacts disposed in the housing. Each of the power contacts has a plate-like body member including at least one of an upper section having a notch formed therein and a separate lower section adapted for fitting within the notch. Some of the power contacts are disposed in the housing such that adjacent power contacts include only one of the upper section and the lower section.

In accordance with another preferred embodiment, there has now been provided an electrical connector including a header electrical connector and a receptacle electrical connector. The header connector includes a header housing and a plug contact disposed in the header housing. The plug contact has a pair of plate-like body members and a plurality of beams extending therefrom. The receptacle connector includes a receptacle housing and a receptacle contact disposed in the receptacle housing. The receptacle contact has a second pair of plate-like body members and a second plurality of beams extending therefrom. The force required to mate the header electrical connector with the receptacle electrical connector is about 10N per contact or less.

In accordance with yet another preferred embodiment of the present invention, there has now been provided an electrical connector including a housing, a first power contact, and second power contact. The second power contact has an amperage rating this is higher than that of the first power contact.

Other preferred embodiments of power contacts include two or more opposing contact beams of a first type that are spaced apart along at least a portion of the length thereof when the power contact is in an unmated state; and two or more opposing contact beams of a second type. The contact beams of the second type are spaced apart so that the contact beams of the second type pinch the contact beams of the first type when the power contact is mated with a mating contact, thereby causing the contact beams of the first type of deflect inwardly toward each other.

Preferred embodiments of power contacts comprise a first half comprising a first plate-like body member, a first type of contact beam electrically and mechanically connected to the first body member, and a second type of contact beam electrically and mechanically connected to the first body member.

The power contacts also comprise a second half comprising a second plate-like body member, another of the first type of contact beams electrically and mechanically connected to the second body member and at least partially spaced apart from the first type of contact beam of the first half by a first gap when the power contact is in an unmated state, and another of the second type of contact beams electrically and mechanically connected to the second body member and at least partially spaced apart from the second type of contact beam of the first half by a second gap when the power contact is in the unmated state.

Other preferred embodiments of power contacts comprise a first contact beam having a mating surface, and a major surface located on an opposite side of the first contact beam from the mating surface. The power contacts also comprise a second contact beam having a mating surface, and a major surface located on an opposite side of the second contact beam from the mating surface of the second contact beam. The major surface of the second contact beam is at least partially spaced apart from the major surface of the first contact beam when the power contact is in an unmated state whereby the first and second contact beams can deflect toward each other as the power contact is mated The power contacts also comprise a third contact beam having a mating surface, and a fourth contact beam having mating surface that faces the mating surface of the third contact beam.

Preferred embodiments of connector systems comprise a first power contact comprising a first contact beam and an opposing second contact beam. At least a portion of the second contact beam is spaced apart from the first contact beam when the first and second power contacts are in an un-mated state. The connector systems also comprise a second power contact matable with the first power contact. The second power contact comprises a third and an opposing fourth contact beam. The third and fourth contact beams pinch the first and second contact beams and cause the first and second contact beams to deflect toward each other as the first and second power contacts are mated.

BRIEF DESCRIPTION OF THE DRAWINGS

FIG. 34 is a perspective view of an exemplary connector that includes power and signal contact subassemblies shown in FIGS. 32 and 33, respectively.

FIG. 35 is a perspective view of an exemplary power contact having opposing plates that are stacked together in a first region and spaced apart in a second region.

DETAILED DESCRIPTION OF ILLUSTRATIVE EMBODIMENTS

Figure 1:
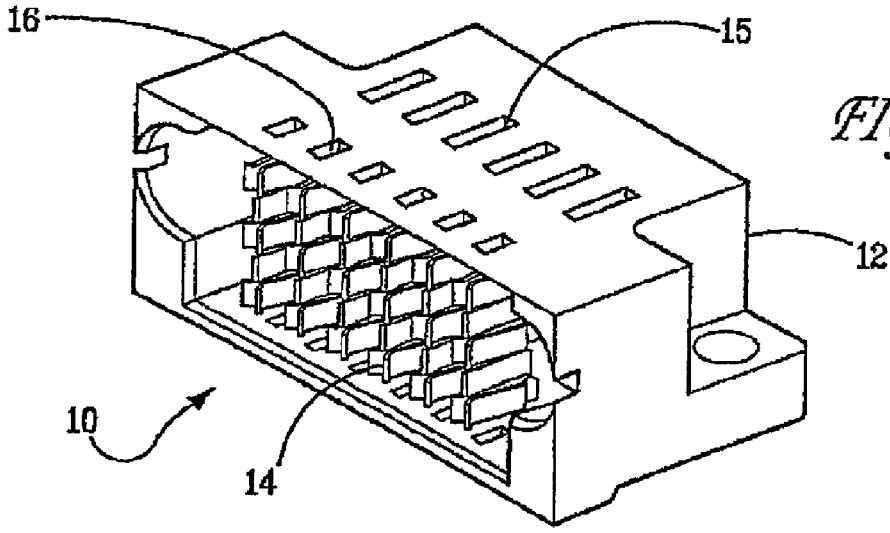
FIG. 1 is a front perspective view of an exemplary header connector provided by the present invention.
Figure 2:
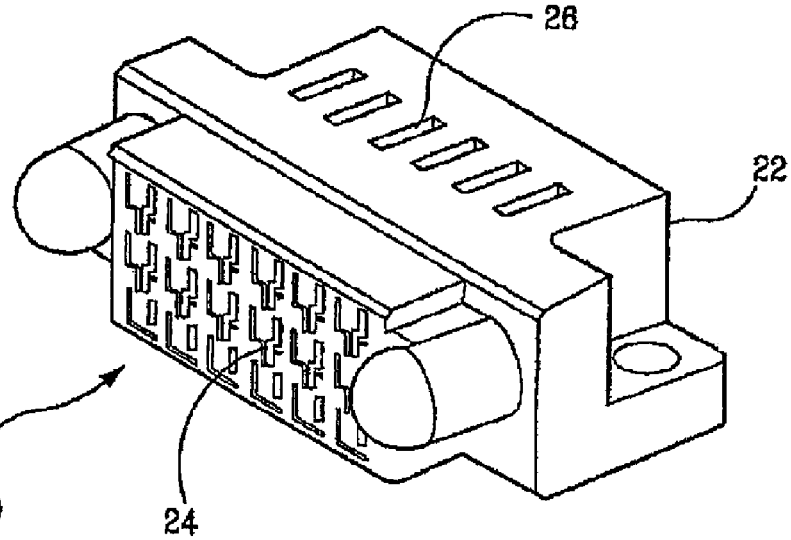
FIG. 2 is a front perspective view of an exemplary receptacle connector that is matable with the header connector shown in FIG. 1.

Referring to FIG. 1, an exemplary header connector 10 is shown having a connector housing 12 and a plurality of power contacts 14 disposed therein. Housing 12 optionally includes apertures 15 and 16 for enhancing heat transfer. Apertures 15 and 16 may extend into a housing cavity wherein the power contacts 14 reside, thus defining a heat dissipation channel from the connector interior to the connector exterior. An exemplary mating receptacle connector 20 is illustrated in FIG. 2. Receptacle connector 20 has a connector housing 22 and a plurality of power contacts disposed therein that are accessible through openings 24. Housing 22 may also employ heat transfer features, such as, for example, apertures 26. The connector housing units are preferably molded or formed from insulative materials, such as, for example, a glass-filled high temperature nylon, or other materials known to one having ordinary skill in the area of designing and manufacturing electrical connectors. An example is disclosed in U.S. Pat. No. 6,319,075, herein incorporated by reference in its entirety. The housing units of the electrical connectors may also be made from non-insulative materials.

Figure 3:
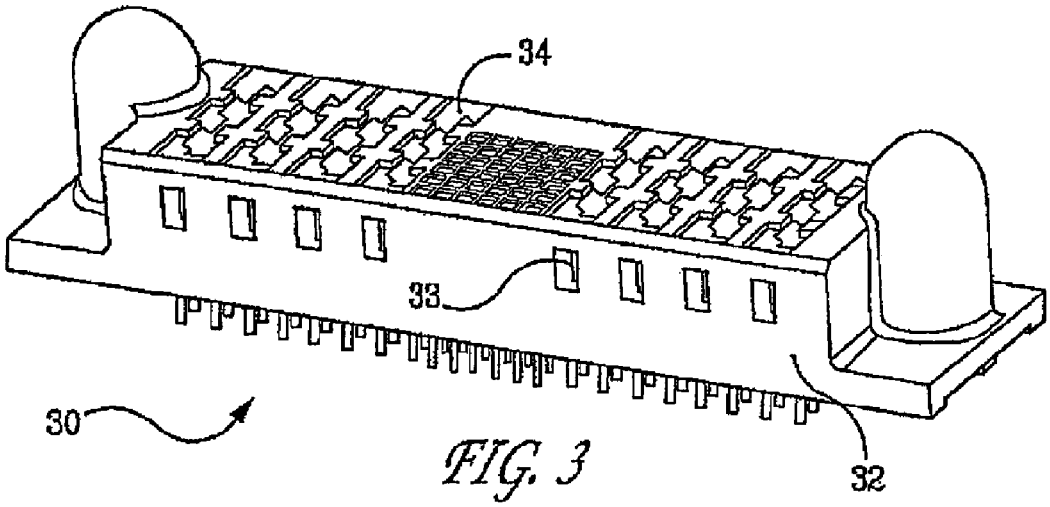
FIG. 3 is perspective view of an exemplary vertical receptacle connector including both power and signal contacts.
Figure 4:
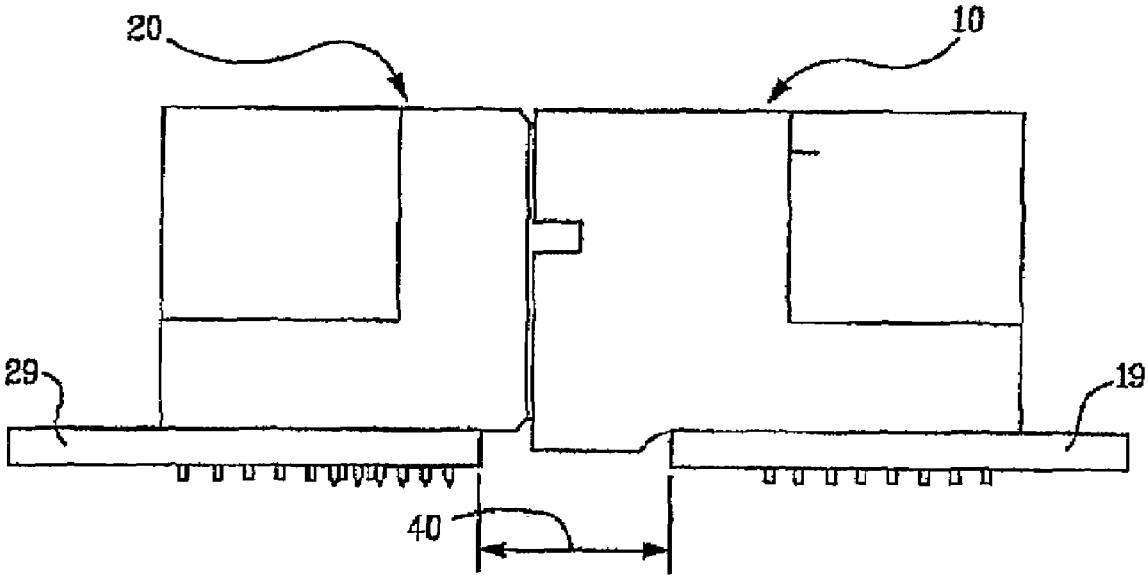
FIG. 4 is an elevation view of the header connector shown in FIG. 1 mated with the receptacle connector shown in FIG. 2.
Figure 5:
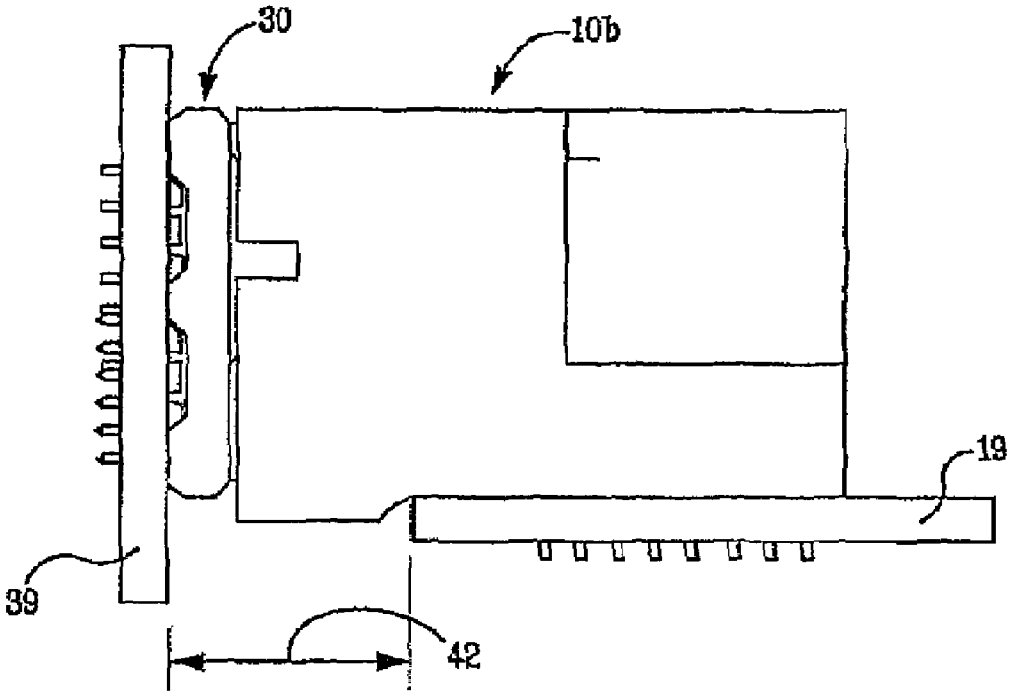
FIG. 5 is an elevation view of an exemplary header connector mated with the receptacle connector shown in FIG. 3.

Header connector 10 and receptacle connector 20 are both designed for a right angled attachment to a printed circuit structure, whereby the corresponding printed circuit structures are coplanar. Perpendicular mating arrangements are also provided by the present invention by designing one of the electrical connectors to have vertical attachment to a printed circuit structure. By way of example, a vertical receptacle connector 30 is shown in FIG. 3. Receptacle connector 30 comprises a housing 32 having a plurality of power contacts disposed therein that are accessible via openings 34. Connector 30 also comprises optional heat dissipation apertures 33. In both coplanar and perpendicular mating arrangements, it is beneficial to minimize the spacing between two associated printed circuit structures to which the connectors are attached. Header 10 is shown mated with receptacle 20 in FIG. 4. The electrical connectors are engaged with coplanar printed circuit structures 19 and 29. The edge-to-edge spacing 40 between printed circuit structures 19 and 29 is preferably 12.5 mm or less. A perpendicular mating arrangement with a header connector 10*b* and receptacle connector 30 is shown in FIG. 5. The edge-to-edge spacing 42 between printed circuit structure 19 and a printed circuit structure 39, to which vertical receptacle connector 30 is engaged, is again preferably 12.5 mm or less. Edge-to-edge spacing is about 9-14 mm, with 12.5 mm being preferred. Other spacings are also possible.

Figure 6:
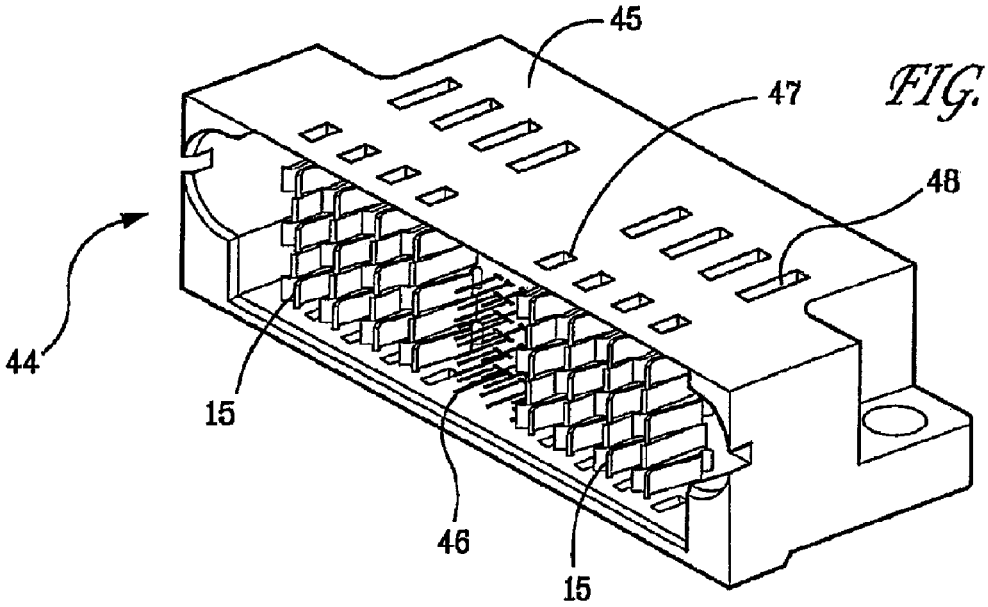
FIG. 6 is a front perspective view of another exemplary header connector in accordance with the present invention.
Figure 7:
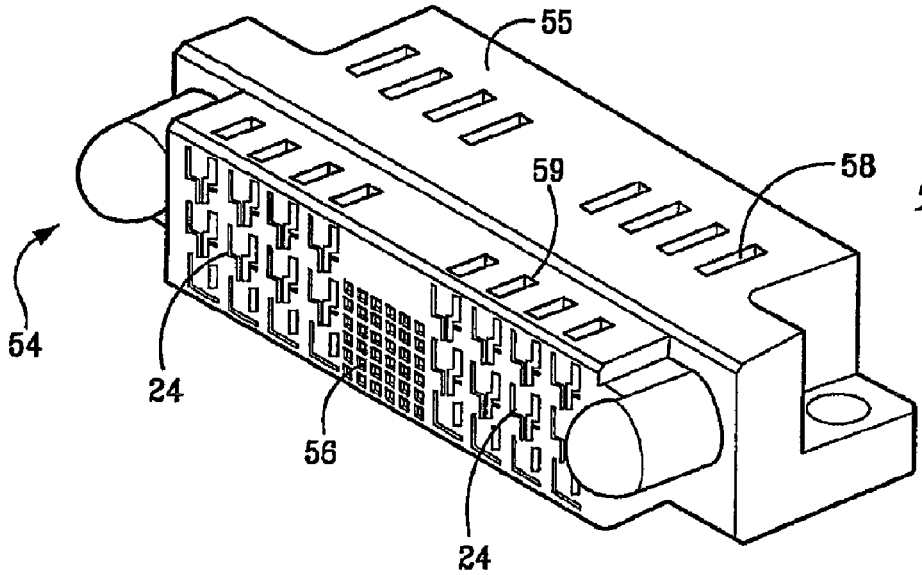
FIG. 7 is a front perspective view of a receptacle connector that is matable with the header connector shown in FIG. 6.

At least some of the preferred electrical connectors include both power and signal contacts. Referring now to FIG. 6, an exemplary header connector 44 is illustrated, having a housing 45, an array of power contacts 15, an array of signal contacts 46, and optional heat transfer apertures 47 and 48 formed in housing 45. A receptacle connector 54, which is suitable for mating with header 44, is shown in FIG. 7. Receptacle connector 54 includes a housing 55, an array of power contacts accessible through openings 24, an array of signal contacts accessible through openings 56, an optional heat transfer apertures 58 extending through housing 55.

Figure 8:
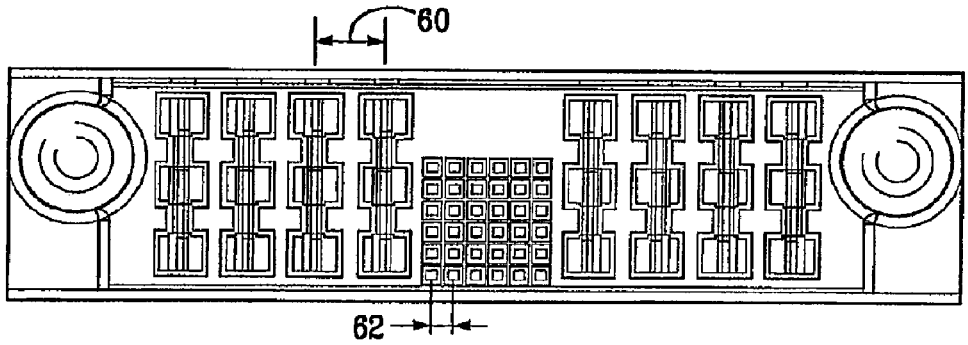
FIG. 8 is an elevation view of a receptacle connector illustrating one preferred centerline-to-centerline spacing for power and signal contacts.

Preferred connector embodiments are extremely compact in nature. Referring now to FIG. 8, centerline-to-centerline spacing 60 of adjacent power contacts is preferably 6 mm or less, and centerline-to-centerline spacing 62 of adjacent signal contacts is preferably 2 mm or less. Note that connectors of the present invention may have different contact spacing than this preferred range.

Figure 9:
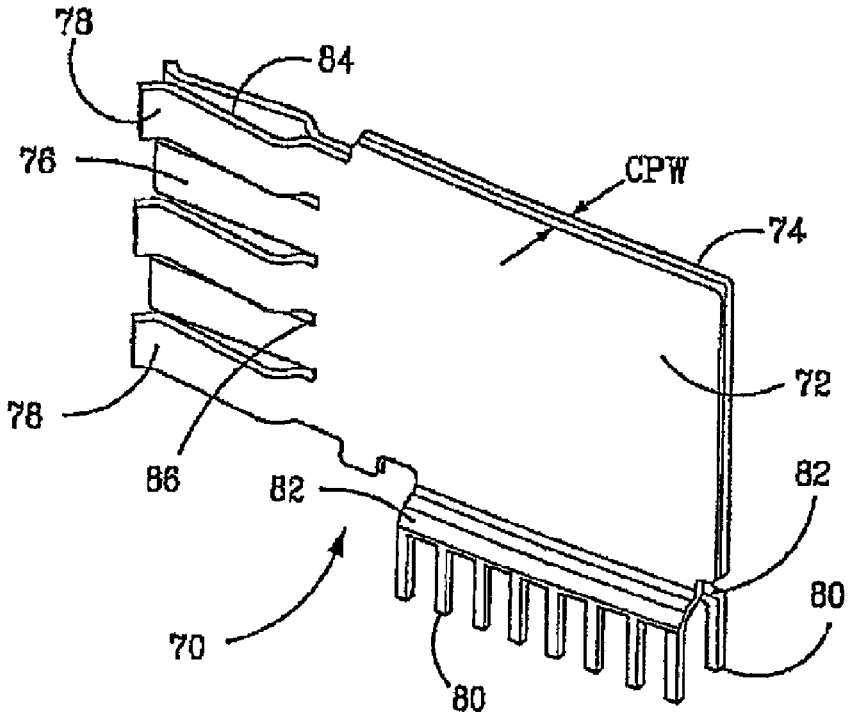
FIG. 9 is a perspective view of an exemplary power contact provided by the present invention.

A number of preferred power contact embodiments that are suitable for use in the above-described connectors will now be discussed. One preferred power contact 70 is shown in FIG. 9. Power contact 70 can be used in a variety of different connector embodiments, including, for example, header connector 10 shown in FIG. 1. Power contact 70 includes a first plate-like body member 72 (may also be referred to as a "plate") stacked against a second plate-like body member 74. A plurality of straight or flat beams 76 (also referred to as blades) and a plurality of bent or angled beams 78 alternatingly extending from each of the body members. The number of straight and bent beams may be as few as one, and may also be greater than that shown in the figures. With the body members in a stacked configuration, beams 78 converge to define "pinching" or "receptacle" beams. The contact beam design minimizes potential variation in the contact normal force over the life of the product through alternating opposing pinching beams. This beam design serves to cancel out many of the additive contact forces that would otherwise be transferred into the housing structure. The opposing pinching beams also aid in keeping the plate-like body members sandwiched together during mating complementary connectors. The contact design provides multiple mating points for a lower normal force requirement per beam, thus minimizing the damaging effect of multiple matings.

When power contact 70 is mated with a complementary power contact, beams 78 necessarily flex, deflect or otherwise deviate from their non-engaged position, while beams 76 remain substantially in their non-engaged position. Power contact 70 further includes a plurality of terminals 80 extending from a flared portion 82 of each of body members 72 and 74. The non-flared portions define a combined plate width CPW. Flared portion 82 provides proper alignment of terminals 80 with attachment features of a printed circuit structure, whereby in preferred embodiments, the distance between distal ends of opposing terminals is greater than combined plate width CPW. The terminals themselves may be angled outwardly so that a flared body portion is unnecessary to establish proper spacing when contact body members are stacked or otherwise positioned closely to one another (see, e.g., the terminals in FIG. 28). Flared portion 82 may also provide a channel for heat dissipation, predominantly via convection. Additional heat dissipation channels may be provided by a space 84 defined between beams 78, and a space 86 defined between adjacent beams extending from a contact body member.

Figure 10:
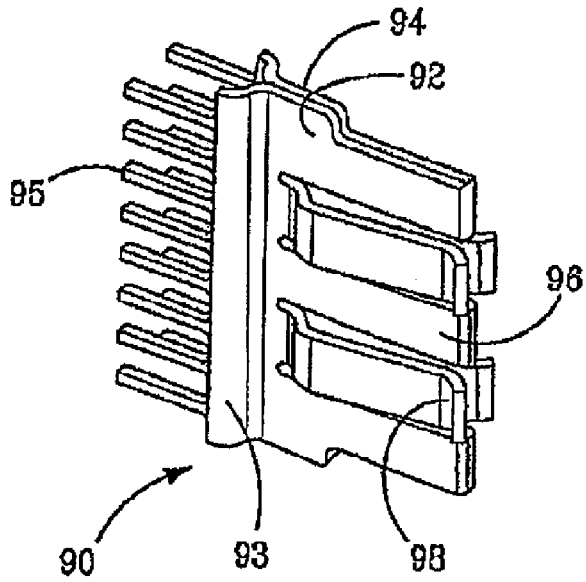
FIG. 10 is a perspective view of a power contact that is matable with the power contact shown in FIG. 9.
Figure 11:
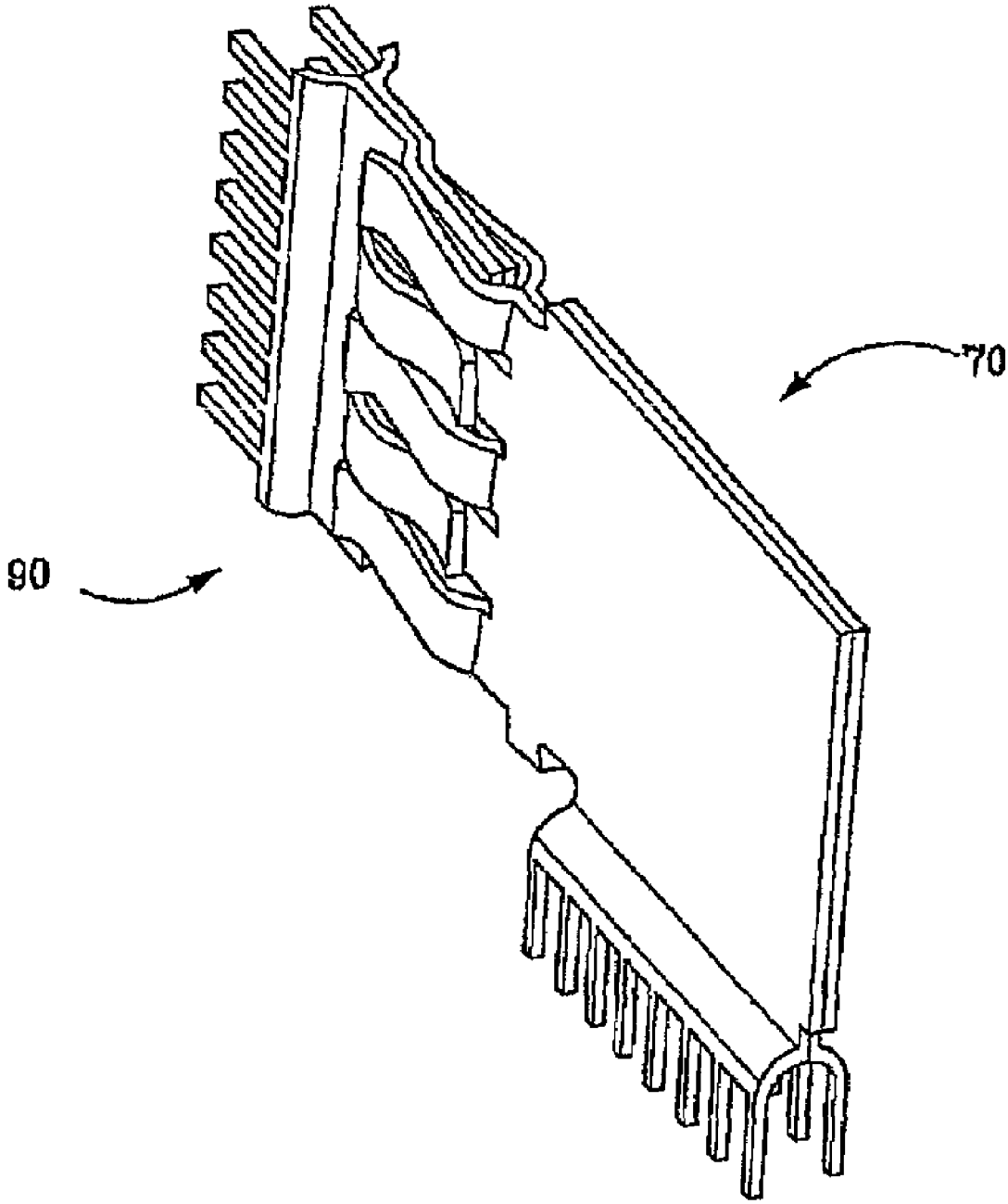
FIG. 11 is perspective view of the power contact shown in FIG. 9 being mated with the power contact shown in FIG. 10.

Referring now to FIG. 10, a power contact 90 is shown which is suitable for mating with power contact 70. Power contact 90 includes a pair of stacked plate-like body members 92 and 94. Straight beams 96 and angled beams 98 extend from the body members and are arranged so as to align properly with beams 78 and 76, respectively, of power contact 70. That is, beams 78 will engage beams 96, and beams 76 will engage beams 98. Each of body members 92 and 94 include a plurality of terminals 95 extending from flared portion 93 for electrically connecting power contact 90 to a printed circuit structure. Power contacts 70 and 90 are illustrated in a mated arrangement in FIG. 11.

Figure 12:
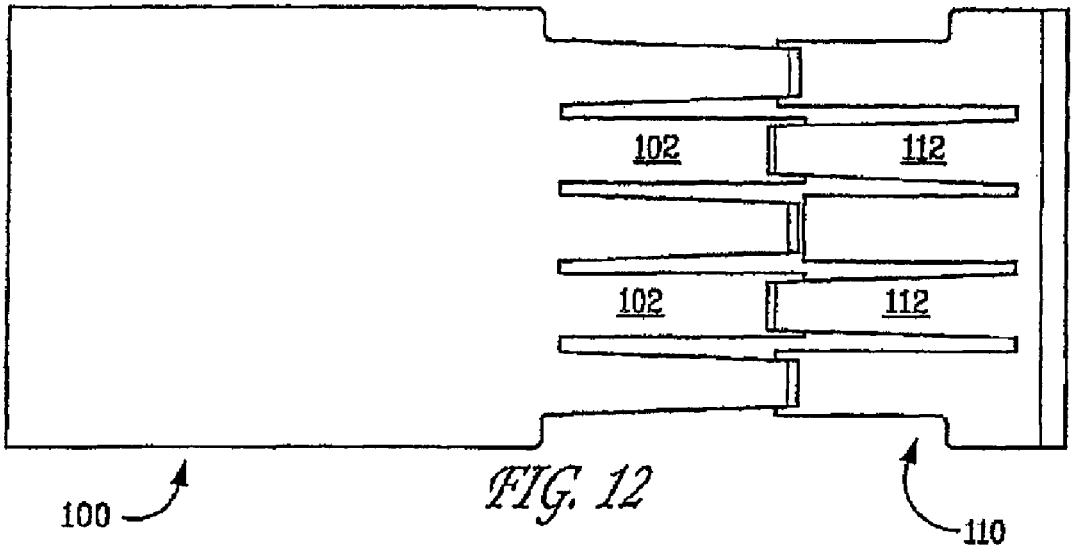
FIGS. 12-14 are elevation views of exemplary power contacts at three levels of engagement.
Figure 13:
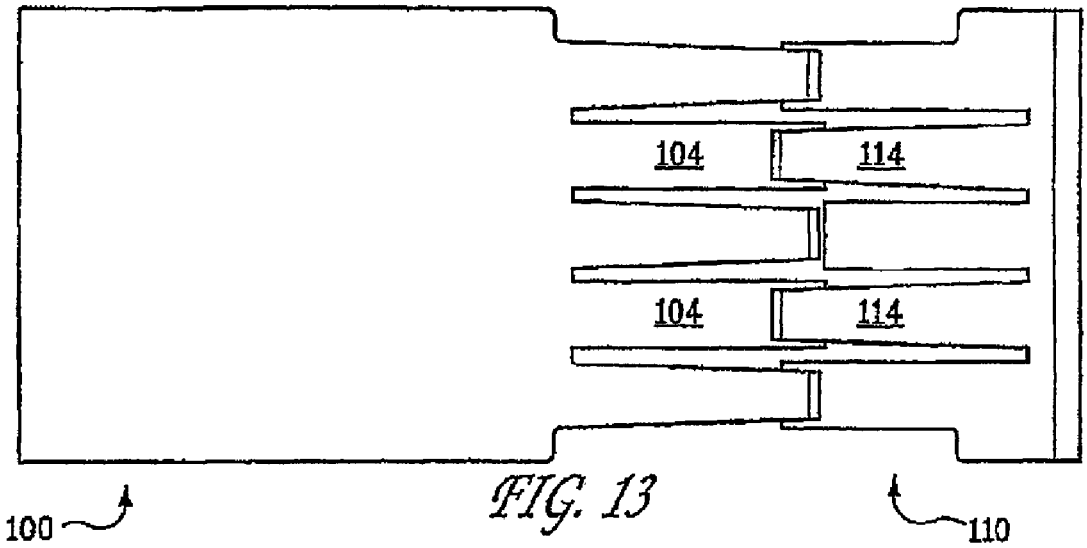
Figure 14:
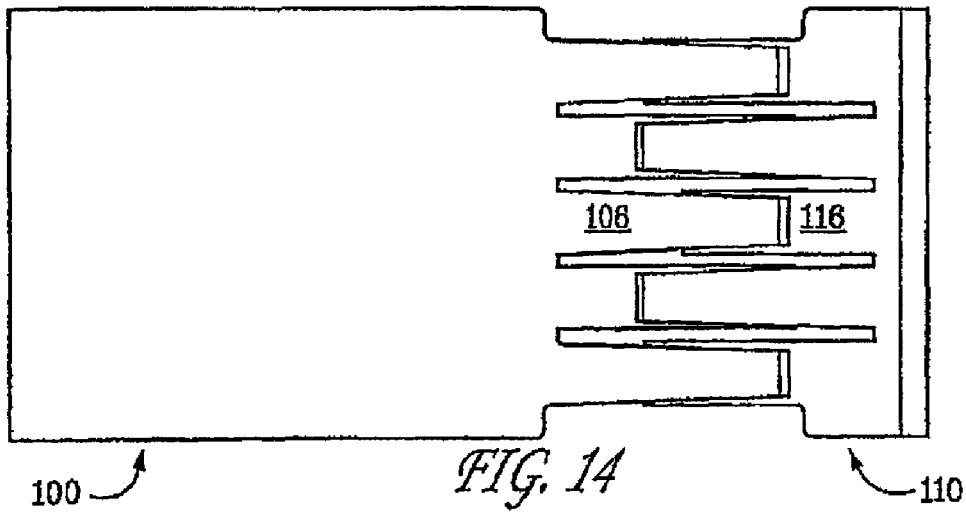

To reduce the mating force of complementary power contacts and electrical connectors housing the same, contact beams can have staggered extension positions via dimensional differences or offsetting techniques. By way of example, FIGS. 12-14 show illustrative power contacts 100 and 110 at different mating positions (or insertion distances) from an initial engagement to a substantially final engagement. In FIG. 12, representing a first level of mating, the longest straight beams or blades 102 of contact 100 engage corresponding pinching beams 112 of contact 110. The force at the first level of mating will initially spike due to the amount of force required to separate or deflect the pinching beams with insertion of the straight beams or blades. Thereafter, the mating force at the first level of mating is primarily due to frictional resistance of the straight and angled beams when sliding against one another. A second level of mating is shown in FIG. 13, wherein the next longest straight beams or blades 114 of contact 110 engage corresponding pinching beams 104 of contact 100. The mating force during the second level of mating is due to additional pinching beams being deflected apart and the cumulative frictional forces of engaged beams at both the first and second mating levels. A third level of mating is shown in FIG. 14, with the remaining straight beam or blade 116 of contact 100 engaging the remaining corresponding pinching beam 106 of contact 100. One of ordinary skill in the art would readily appreciate that fewer or greater levels of mating, other than three in a given power contact and in an array of power contacts within the same connector, is contemplated by the present invention. As noted above, electrical connectors of the present invention may employ both power and signal contacts. The signal contacts, can also be staggered in length with respect to one another and, optionally, with respect to the lengths of the power contacts. For example, the signal contacts may have at least two different signal contact lengths, and these lengths may be different than any one of the power contact lengths.

Figure 15:
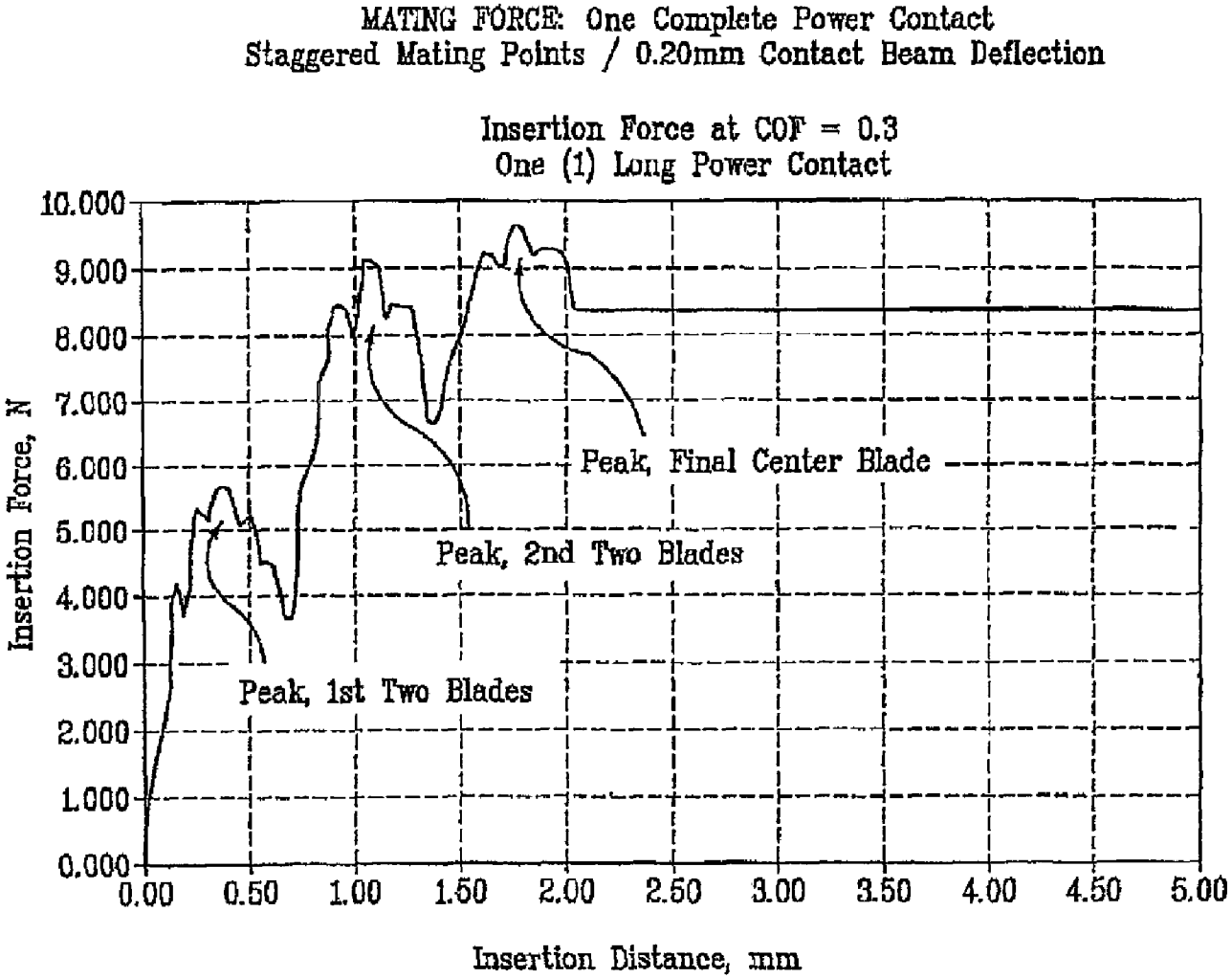
FIGS. 15-19 are graphs illustrating representative mating forces versus insertion distance for various exemplary power contacts provided by the present invention.
Figure 16:
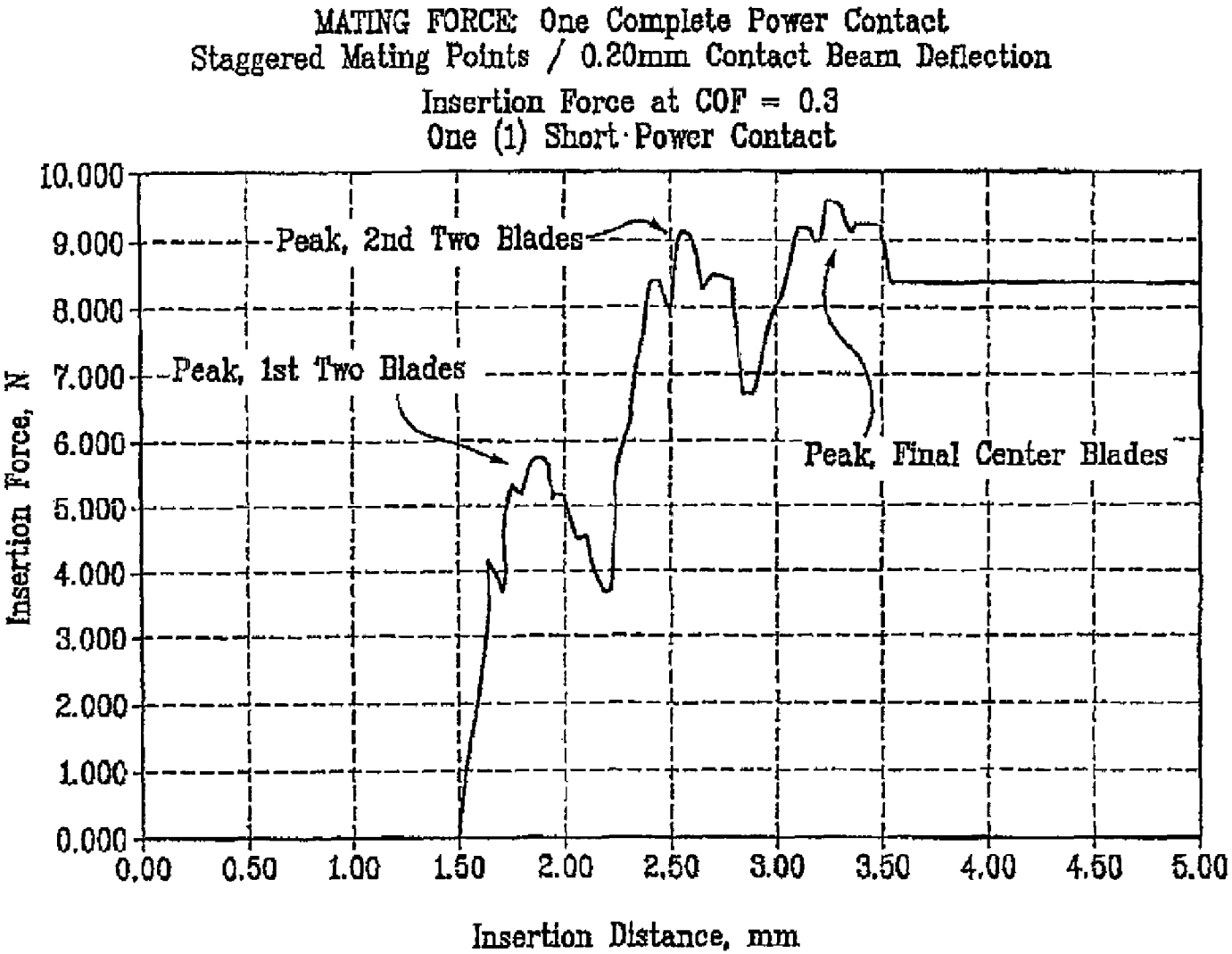
Figure 17:
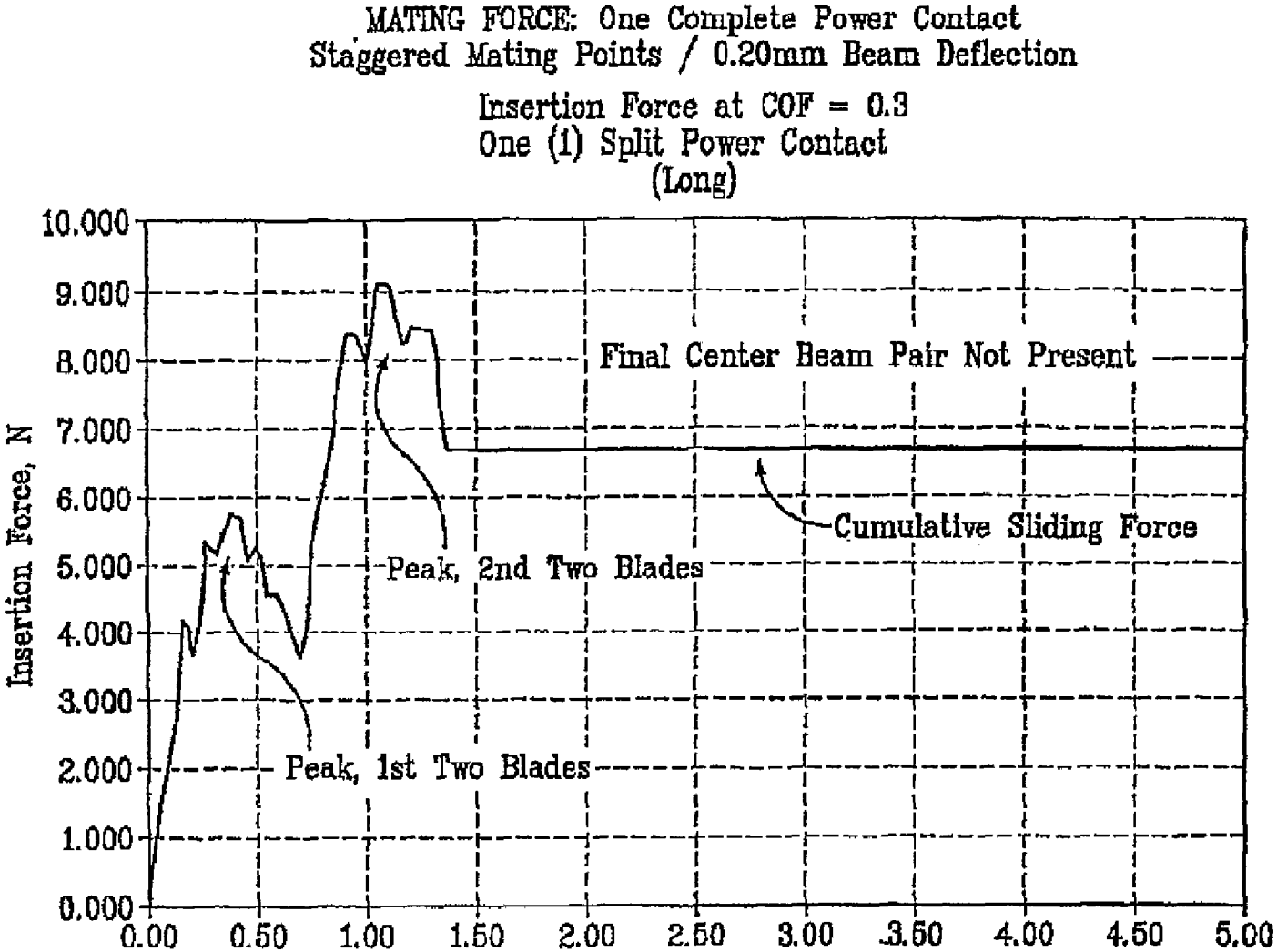
Figure 18:
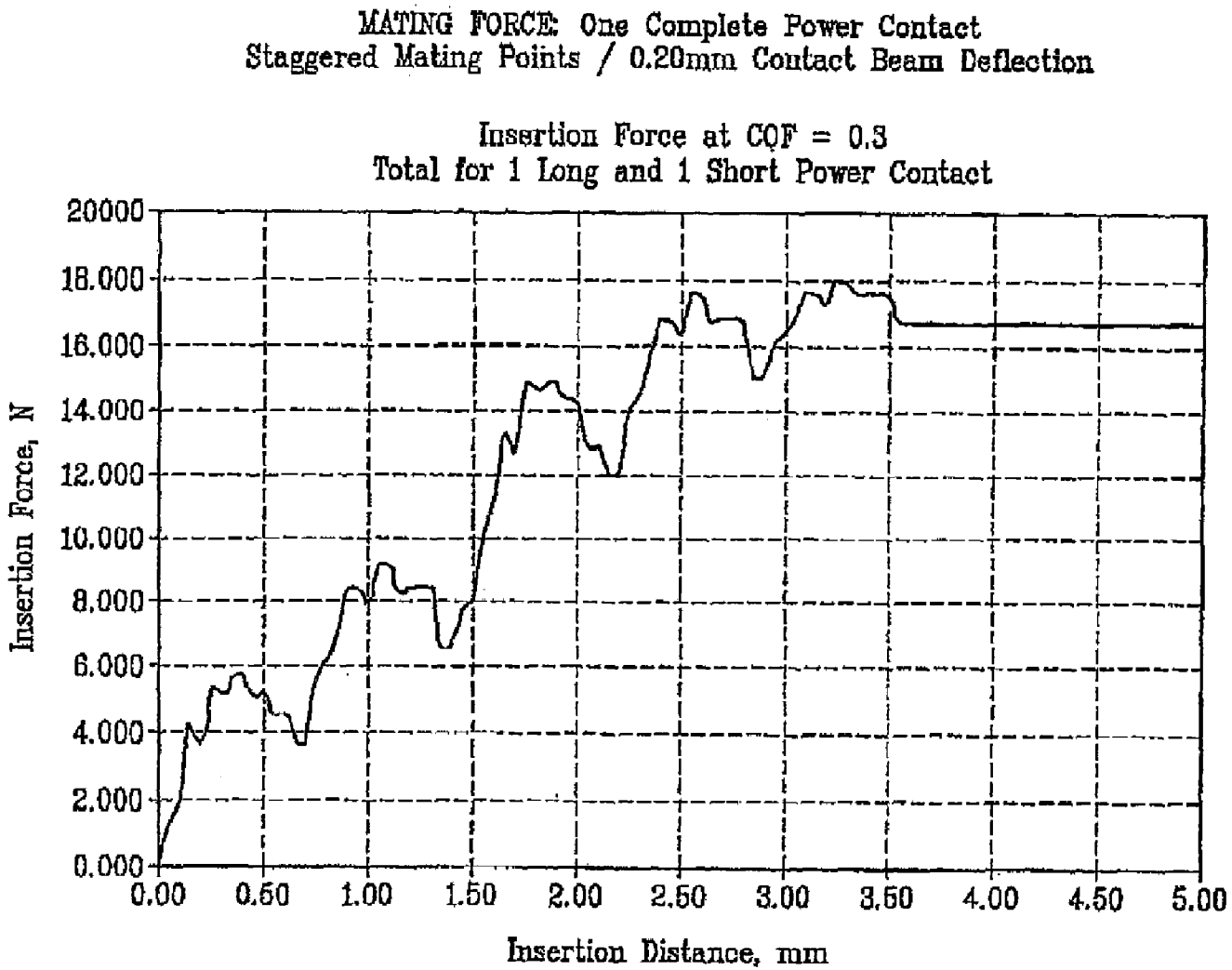
Figure 19:
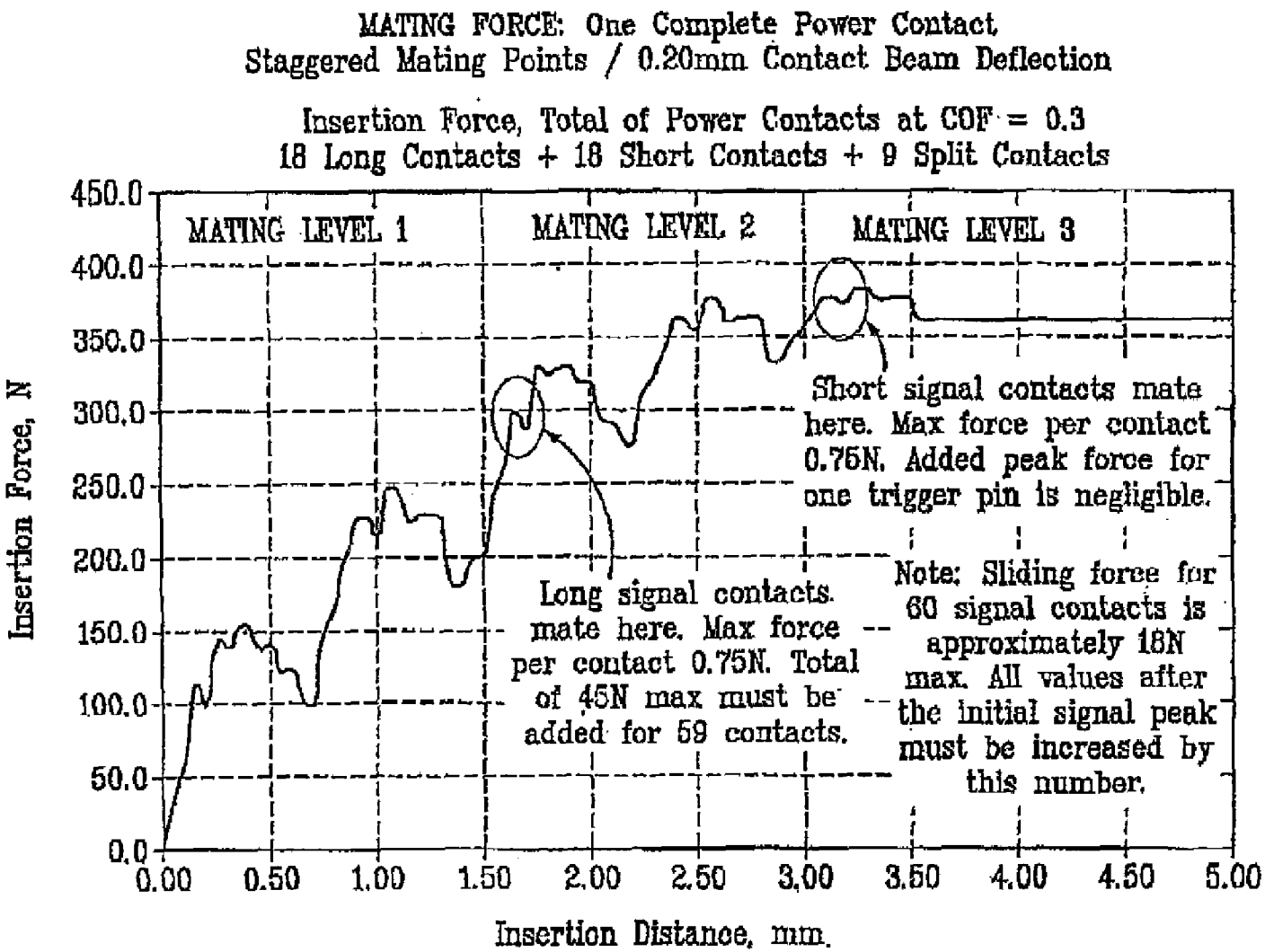

FIGS. 15-19 are graphs showing representative relationships of mating forces versus insertion distance for various exemplary power contacts (discussed above or below). Mating force for an exemplary power contact employing three levels of mating is shown in FIG. 15, with the peaks representing deflection of pinching beams with engaging straight beams at each mating level. If the power contact did not employ staggered mating, the initial force would essentially be 2.5 times the first peak of about 8N, or 14.5 N. With staggered mating points, the highest force observed throughout the entire insertion distance is less than 10 N.

It is apparent to one skilled in the art that the overall size of a power connector according to the present invention is constrained, in theory, only by available surface area on a bus bar or printed circuit structure and available connector height as measured from the printed circuit structure. Therefore, a power connector system can contain many header power and signal contacts and many receptacle power and signal contacts. By varying the mating sequence of the various power and signal contacts, the initial force needed to mate a header with a receptacle is lower when the two power connectors are spaced farther apart (initial contact) and increases as the distance between the connector header and connector receptacle decreases and stability between the partially mated header and receptacle increases. Applying an increasing force in relation to a decreasing separation between the connector header and connector receptacle cooperates with mechanical advantage and helps to prevent buckling of the connector header and receptacle during initial mating.

Figure 20:
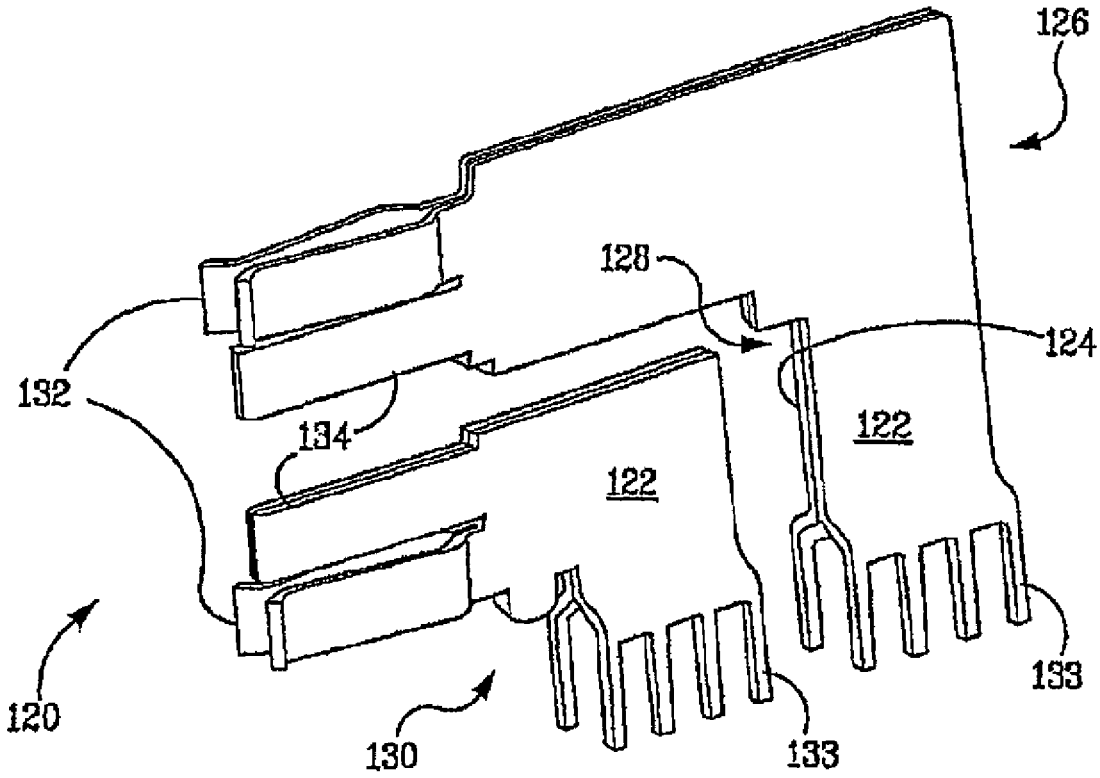
FIG. 20 is a perspective view of a split contact in accordance with the present invention.
Figure 21:
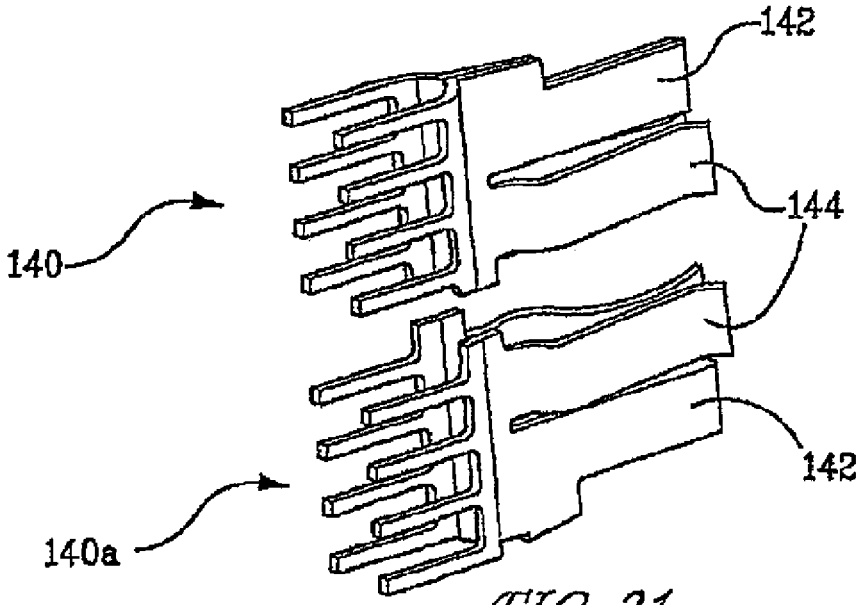
FIG. 21 is a perspective view of power contacts that are matable with the upper and lower sections of the split contact shown in FIG. 20.

Another exemplary power contact 120 is shown in FIG. 20. Power contact 120 comprises first and second plate-like body members 122 and 124. Power contact 120 can be referred to as a split contact that has an upper section 126 with a notch 128 formed therein for receiving a lower section 130. Upper section 126 is shown having an L-shape; however, other geometries can equally be employed. Lower section 130 is designed to substantially fit within notch 128. As shown, upper section 126 and lower section 130 each have a pair of angled beams 132 and a pair of straight beams 134 extending from a front edge, and a plurality of terminals 133 for engaging a printed circuit structure. The number and geometry of the beams can vary from that presented in the figures. FIG. 21 shows a pair of nearly identical power contacts 140, **140*a* in parallel that are suitable for mating with the upper and lower sections of split contact 120. Each power contact 140, 140*a* has a pair of straight beams 142 that can be inserted between the converging angled beams 132 of contact 120, and a pair of converging angled beams 144 for receiving straight beams 134 of contact 120**.

Figure 22:
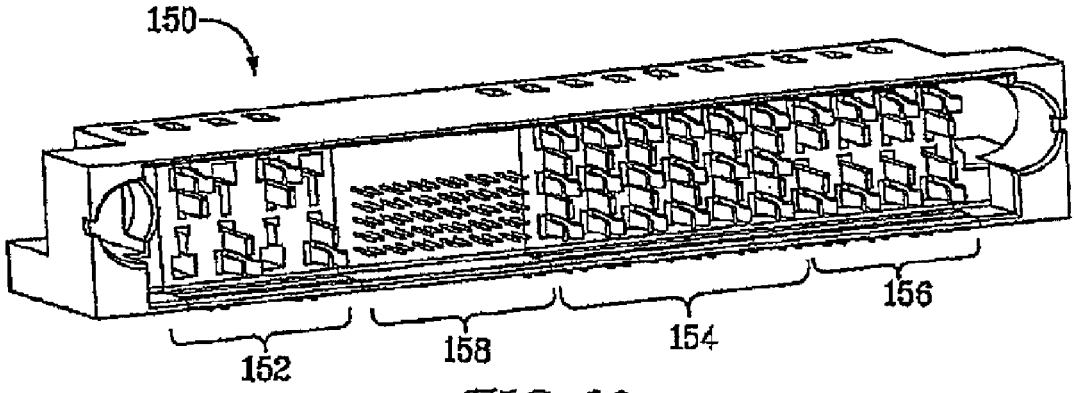
FIG. 22 is perspective view of a header connector comprising power contacts of varying amperage rating.

Note that for a single contact position, as shown in FIG. 22, electrical connectors of the present invention may also employ only one of the upper or lower sections. By alternating upper and lower contacts in adjacent contact positions, extra contact-to-contact clearance distance can be achieved, permitting the contact to carry a higher voltage of around 350V compared to the 0-150V rating associated with the aforementioned contacts shown in FIGS. 9 and 10 and FIGS. 20 and 21 based on published safety standards. The void area 160 left from the non-existing contact section of an associated split contact may provide a channel for dissipating heat. When used in the context of the overall connector assembly, the full contact, the split contact, and the upper or lower section of the split contact, can be arranged such that a variety of amperage and voltage levels can be applied within one connector. For example, exemplary connector 150, shown in FIG. 22, has an array of upper and lower contact sections 152 arranged for high voltage as noted, an array of full contacts 154 capable of approximately 0-50 A, an array of split contacts 156 capable of approximately 0-25 A in reduced space, as well as an array of signal contacts 158. The number of different amperage power contacts can be less than or greater than three. Also, the arrangement of power and signal contacts can vary from that shown in FIG. 22. Lastly, the amperage rating for the different power contacts can vary from that noted above.

Figure 23:
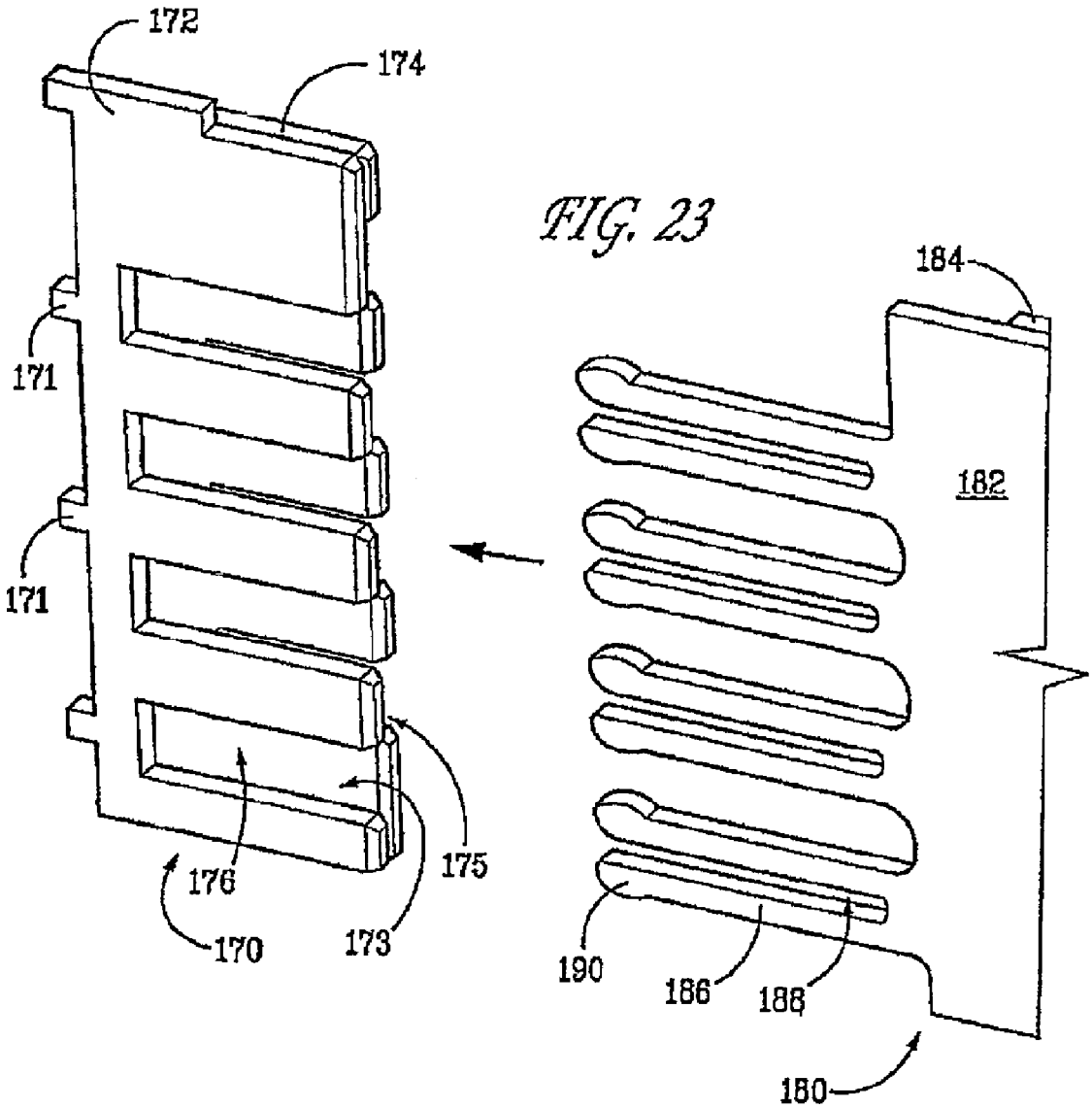
FIG. 23 is a perspective of additional matable power contacts provided by the present invention.

Referring now to FIG. 23, additional matable power contact embodiments are shown. Receptacle power contact 170 comprise a first plate-like body member 172 stacked against a second plate-like body member 174. Each of the first and second plate-like body member includes a series of notches 173 and 175, respectively. Preferably, notch series 173 is out of phase with notch series 175. A plurality of contact receiving spaces 176 are defined by the notches of one plate-like body member and a solid portion of the other plate-like body member. Contact receiving spaces 176 are designed to accept beams from mating plug contacts, such as for example, plug contact 180. At least one of the first and second plate-like body member further includes terminals 171 for attachment to a printed circuit structure. In an alternative receptacle contact embodiment (not shown), a single plate-like body member is employed having a series of notches on its outer surfaces, wherein the notches have a width less than that of the single plate-like body member.

Plug contact 180 comprise a first plate-like body member 182 stacked against a second plate-like body member 184. Each of the first plate-like body member and the second plate-like body member has a plurality of extending beams 186 for engagement with contact receiving spaces 176. As shown, a pair of beams 186 are dedicated for each individual contact receiving space 176 of the mating receptacle contact 170. Multiple single beams may equally be employed. Each pair of beams 186 includes a space 188 that may enhance heat transfer. Beams 186 are compliant and will flex upon engagement with contact receiving spaces 176. Beams 186 may optionally include a bulbous end portion 190. Contact body members 182 and 184 are shown in an optional staggered arrangement to provide a first mate-last break feature.

Figure 24:
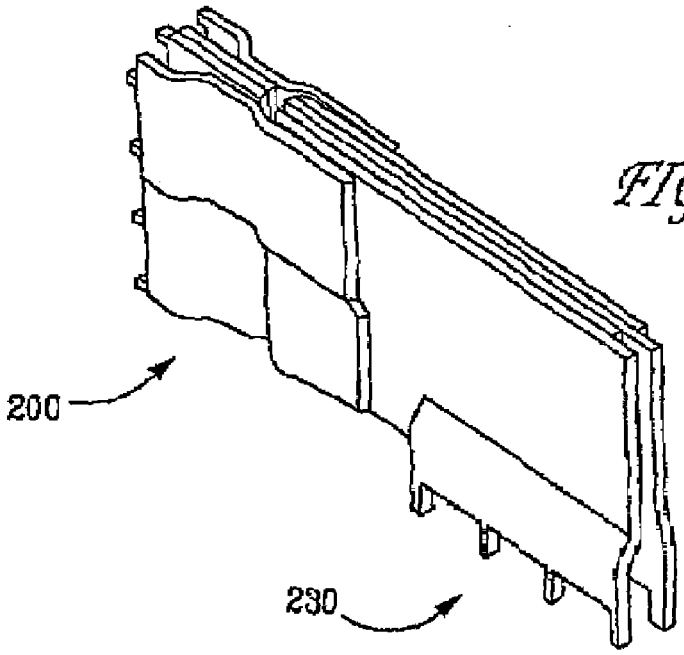
FIGS. 24-26 are perspective views of matable power contacts, each of which includes four stacked body members.
Figure 25:
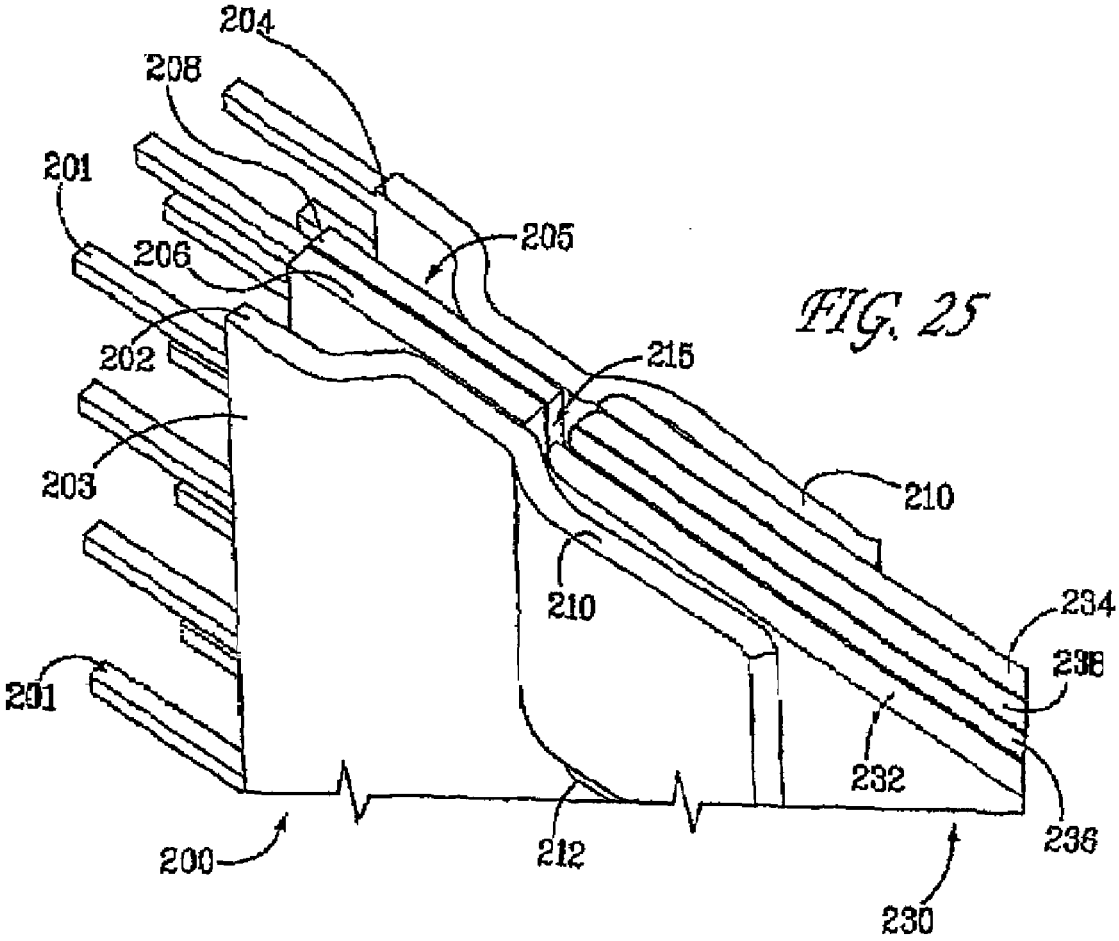
Figure 26:
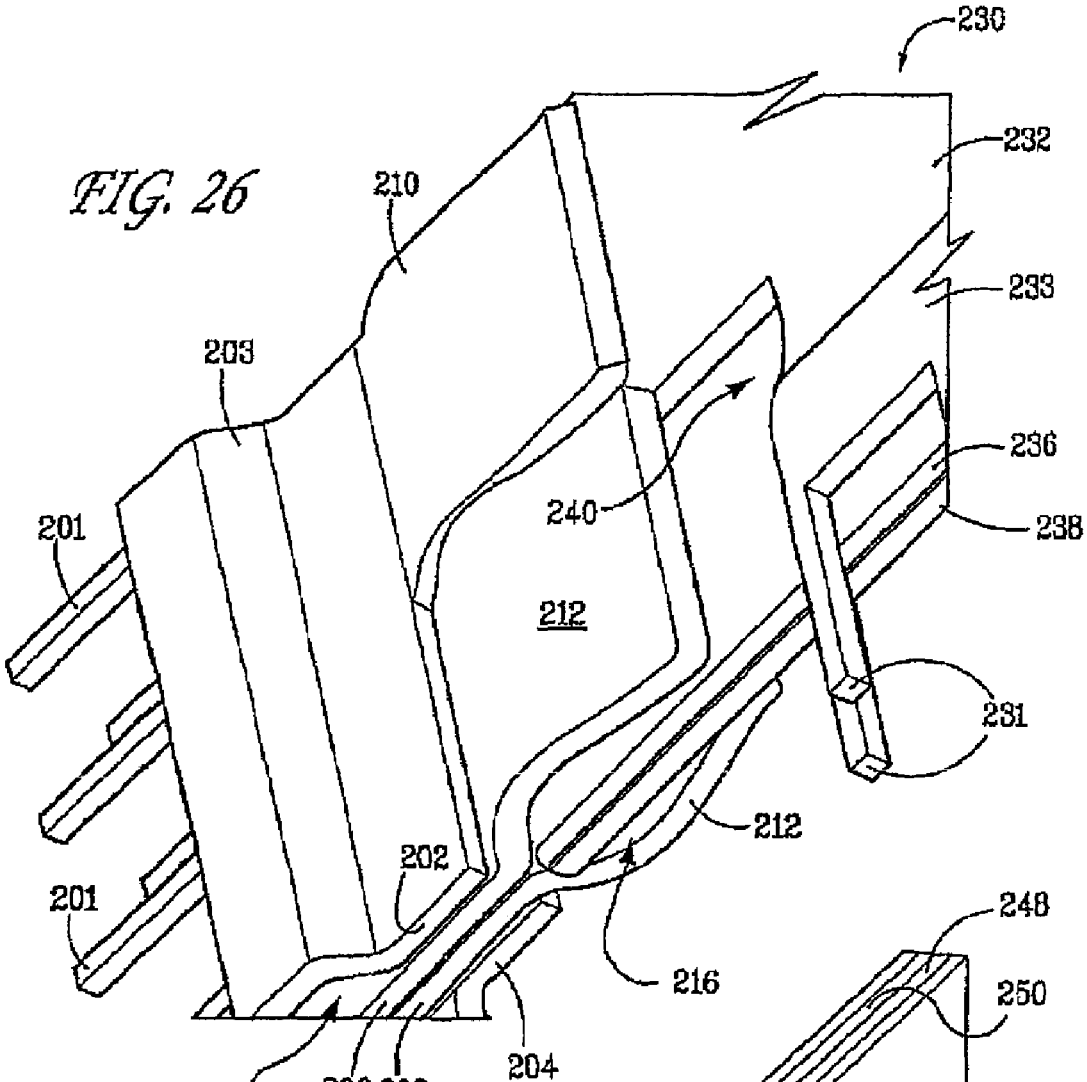

Although the power contacts discussed above have included two plate-like body members, some power contact embodiments (not shown) provided by the present invention include only a single plate-like body member. And other power contact designs of the present invention include more than two plate-like body members. Exemplary receptacle and plug contacts 200 and 230, respectively, are shown in FIGS. 24-26. Each of receptacle contact 200 and plug contact 230 employs four plate-like body members.

Receptacle power contact 200 includes a pair of outer plate-like body members 202 and 204, and a pair of inner plate-like body members 206 and 208. The outer and inner pairs of plate-like body members are shown in a preferred stacked configuration; that is, there is substantially no space defined between adjacent body members along a majority of their opposing surfaces. A plurality of terminals 201 extend from one or more of the plate-like body members, and preferably from all four of the body members. Each of the pair of outer plate-like body members 202, 204 includes a flared portion 203. Flared portion 203 provides proper spacing for terminal attachment to a printed circuit structure and may aid heat dissipation through a defined space 205. A first pair of beams 210 extends from outer body members 202, 204, and a second pair of beams 212 extends from inner body members 206, 208. In a preferred embodiment, and as shown, the first pair of beams 210 is substantially coterminous with the second pair of beams 212. In alternative embodiments, beams 210 and 212 extend to different positions to provide varied mating sequencing. Beams 210, 212 are designed and configured to engage features of mating plug contact 230, and may further define one or more heat dissipation channels between adjacent beams 210, 212, and heat dissipation channels 215 and 216 defined by opposing beams 210 and 212 themselves. Beams 210 and 212 are shown in a "pinching" or converging configuration, but other configurations may equally be employed. The outer and inner pairs of body members may employ additional beams other than that shown for engaging a plug power contact.

Plug contact 230 also has a pair of outer plate-like body members 232 and 234, and a pair of inner plate-like body members 236 and 238. Similar to the receptacle contact, each of the outer plate-like body members 232, 234 includes a flared portion 233 to provide proper spacing for terminals 231 extending from the body members. Outer plate-like body members 232, 234 preferably comprise a cutout section 240. Cutout section 240 exposes a portion of the inner plate-like body members 236, 238 to provide accessibility for engagement by mating receptacle power contact 200, and may aid heat dissipation, such as by convection. By way of example and as shown in FIG. 26, beams 210 of receptacle contact 200 are pinching the exposed portion of inner plate-like body members 236 and 238 of plug contact 230.

Figure 27:
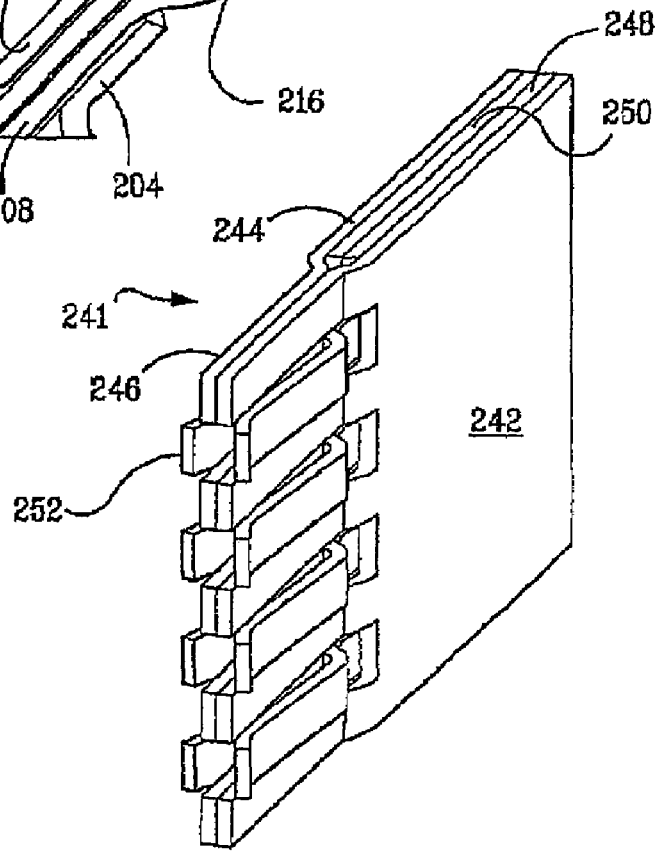
FIG. 27 is a perspective view of another power contact employing four stacked body members.

Another exemplary power contact 241 employing four stacked body members is shown in FIG. 27. Power contact 241 has a pair of outer plate-like body members 242 and 244, each of which has a plurality of straight cantilevered beams 246 extending from a front edge. Power contact 240 also has a pair of inner plate-like body members 248 and 250 that reside between outer plate-like body members 242 and 244. Inner plate-like body members 248 and 250 have a plurality of angled cantilevered beams 252 that converge to define pinching or receptacle beams. The straight beams 246 are spaced apart to permit the angled beams 252 to be disposed therebetween. A preferred matable power contact (not shown) would have a similar structure with pinching beams in registration with beams 246 and straight beams in registration with beams 252. During mating forces encountered by beams 246 would tend to hold outer plate-like body members 242 and 244 together, while forces encountered by beams 252 would tend to push the inner plate-like body members 248 and 250 apart. Collectively the forces would negate one another to provide a stable stack of plate-like body members with a minimal amount of force transferred to a carrier housing. Outer plates 242 and 244 would also tend to hold inner plates 248 and 250 together.

Each of the power contact embodiments shown and described thus far have employed multiple plate-like body members stacked against each other. In this stacked arrangement, the body members touch one another along at least a portion of opposing body member surfaces. The figures show the plate-like body members touching one another along a majority of their opposing surfaces. However, alternative contact embodiments contemplated by the present invention have a minority of their opposing surfaces touching. For example, an exemplary contact 253 is shown in FIG. 35 having a pair of plate-like body members 254 and 255. Contact 253 includes a first region 256 wherein the plate-like body members are stacked against each other, and a second region 257 wherein the body members are spaced apart. The first and second regions 256, 257 are interconnected by an angled region 258. Second region 257 includes a medial space 259 that can facilitate heat dissipation through convection, for example. Note that portions of the plate-like body members that are stacked and that are spaced apart can vary from that shown in FIG. 35. Rather than being stacked to any degree, multiple plate-like body members may also be spaced apart completely so as to define a medial space between adjacent contact body members. The medial space can facilitate heat transfer. Furthermore, one of the mating contacts can have stacked plate-like body member while the other does not—an example of such is shown with the matable contacts 260 and 290 shown in FIGS. 28 and 29, respectively, and described below.

Figure 28:
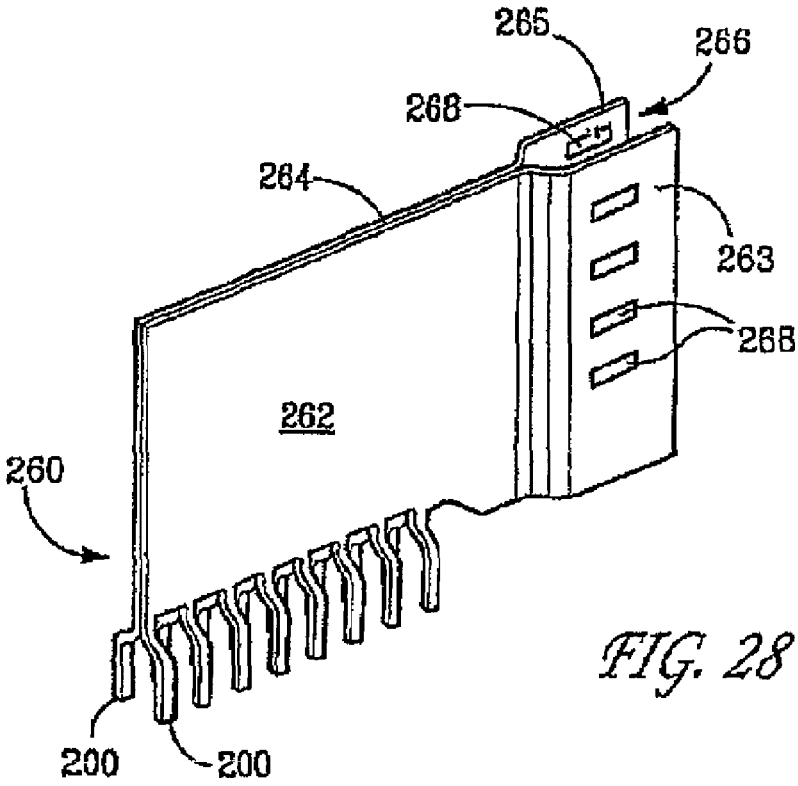
FIG. 28 is a perspective view of power contact embodiment having stacked body members with flared regions that collectively define a contact-receiving space.

Contact 260, shown in FIG. 28, includes a first plate-like body member 262 stacked against a second plate-like body member 264 along a majority of their inner surfaces. Front sections 263, 265 of each of the plate-like body members flare outwardly to define a contact receiving space 266 for engaging mating contact 290 (shown in FIG. 29). Optional apertures 268 are illustrated in flared front sections 263, 265 that may improve heat dissipation.

Contact 290 includes juxtaposed body members 292 and 294, which are preferably spaced apart from one another to define a medial space 296 therebetween. Surface area of body members 292, 294, in combination with medial space 296, allows for heat dissipation, predominantly via convection. A plurality of compliant beams 300, 302 extend from respective juxtaposed body members 292, 294. In one preferred embodiment, beams 300, 302 extend alternatingly from body members 292 and 294. Each of beams 300, 302 has a proximal portion 304 and a distal portion 306. Opposing side portions 308 and 310 are connected by a connecting portion 312, all of which is disposed between the proximal and distal portions 304 and 306. Connecting portion 312 preferably defines a closed beam end that is positioned away from body members 292, 294. Collectively, the foregoing beam portions define a bulb-shaped (or arrow-shaped) beam that provides at least two contact points per each individual beam 300, 302. Although all of contact beams 300, 302 are shown to be identical in size and geometry, the present invention also contemplates multiple beams that are different from one another, varying along one of the body members, as well as varying from body member to body member. The number of beams shown in FIG. 29 can also be altered to include more beams or fewer beams.

Figure 29:
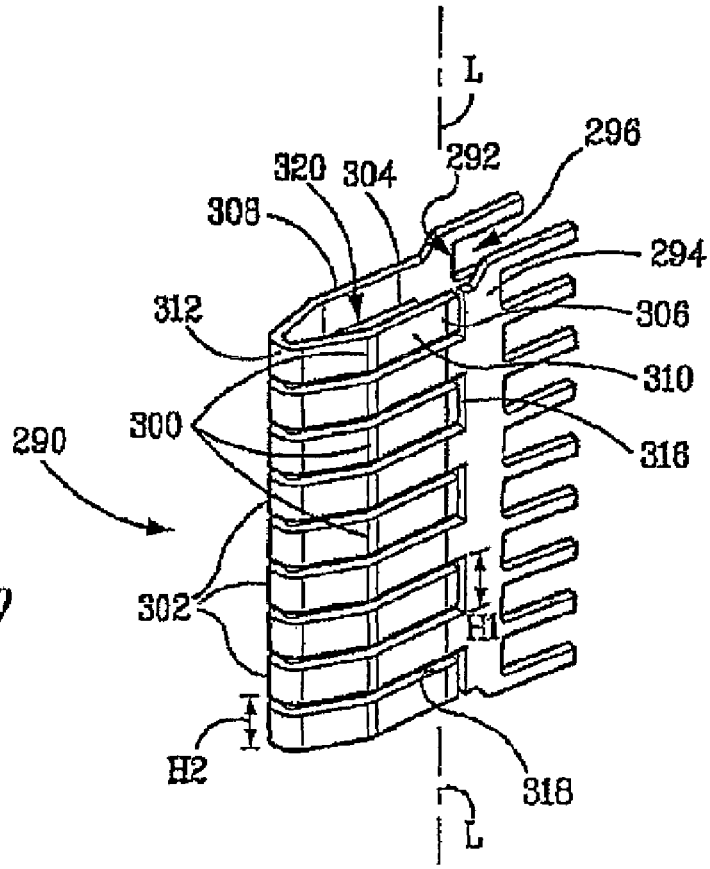
FIG. 29 is a perspective view of a power contact that is insertable into the contact-receiving space of the power contact shown in FIG. 28.

As shown in FIG. 29, distal portion 306 of each beam 300, 302 is spaced apart from the body member from which it does not extend, so that a split 316 is defined. Split 316 helps permit deflection of beams 300, 302 upon insertion into contact receiving space 266. A space 318 is also defined between adjacent beams 300, 302 on each of body members 292, 294. Space 318 has a height H1 that is preferably equal to or greater than a height H2 of the beams 300, 302, such that beams 300 of one body member 292 can be intermeshed with beams 302 of the other body member 294.

Split 316 and spaces 296, 318, and 320 allow heat to dissipate from the body members and compliant beams. In FIG. 29, contact 290 extends along an imaginary longitudinal axis L that lies coincident with the plane P of the page. In the FIG. 29 configuration, heat will dissipate by convection generally upward and along the imaginary longitudinal axis L. The beams 300, 302 and body member 292, 294 define a psuedo-chimney that helps channel heat away from contact 290. If contact 290 is rotated ninety degrees within the plane P of the page, heat can still dissipate through spaces 316 and 318, as well as through open ends of spaces 296 and 320.

Figure 30:
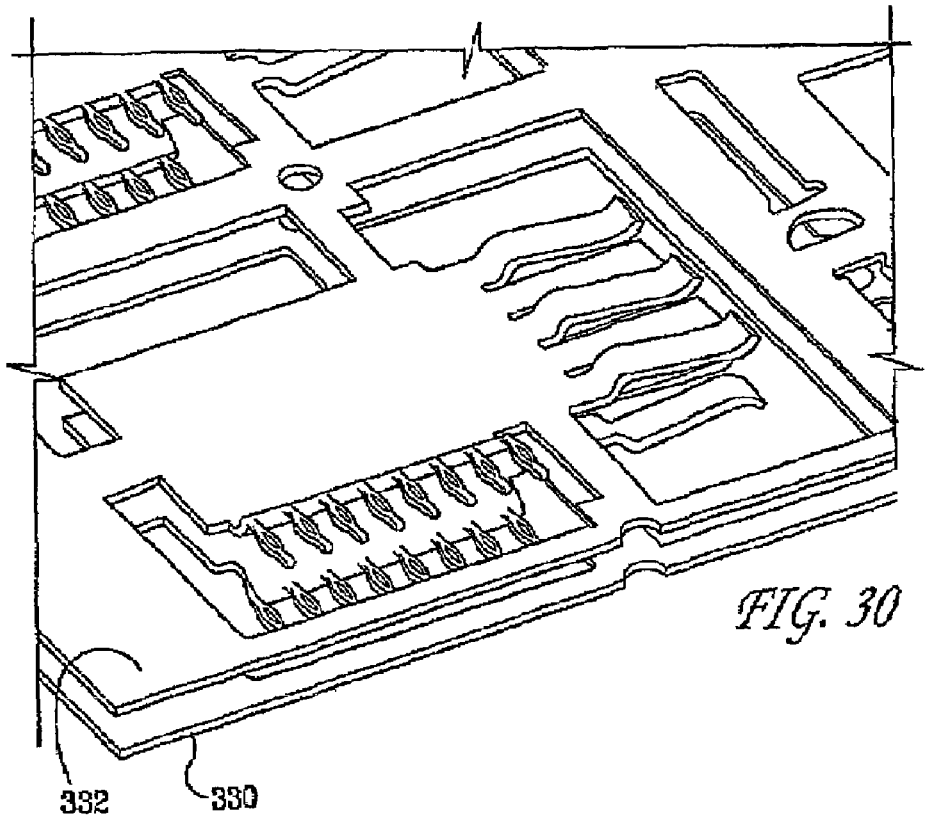
FIG. 30 is a perspective view of stamped strips of material for forming power contacts of the present invention.

Preferred contacts of the present invention may be stamped or otherwise formed from a strip of suitable material. The contacts may be formed individually, or alternatively formed in groups of two or more. Preferably, a strip of material is die-stamped to define multiple contact features in a pre-finished or finished form. Further manipulation may be needed after the die-stamping operation, such as, for example, coupling features together or altering a feature's originally stamped orientation or configuration (e.g., bending cantilevered beams or contact body portions). Referring to FIG. 30, exemplary strips 330 and 332 are shown, each of which has multiple plate-like body members that include straight and bent beams (preferably formed after the stamping operation) and a plurality of terminals extending therefrom. Where a power contact has first and second body members, both the left and right configurations may be stamped and provided in a single strip.

Figure 31:
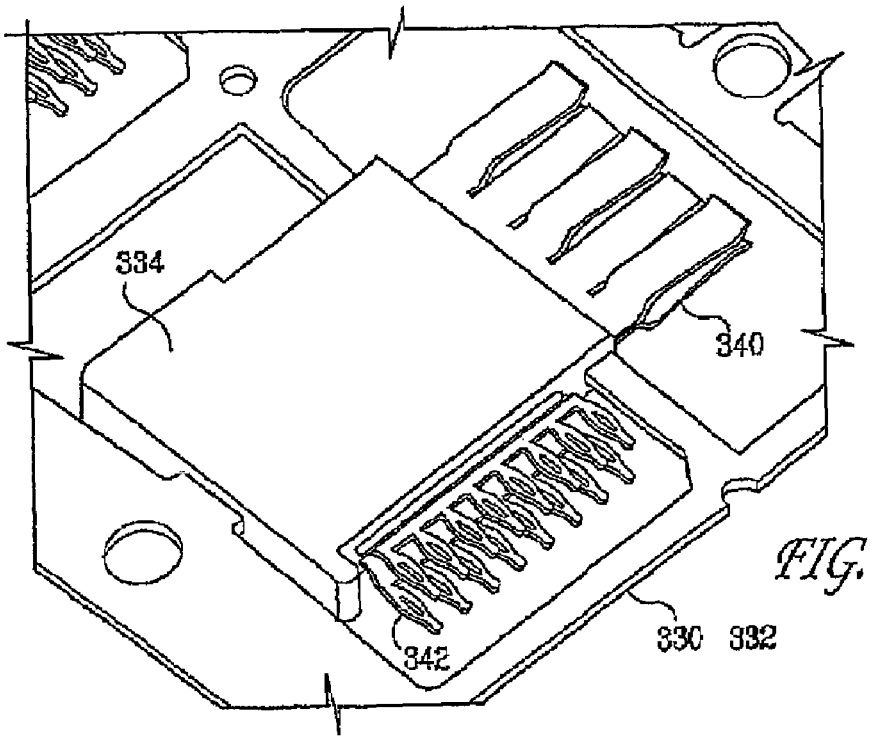
FIG. 31 is a perspective view of the stamped strips of material shown in FIG. 30 that include overmolded material on portions of the stamped strips.
Figure 32:
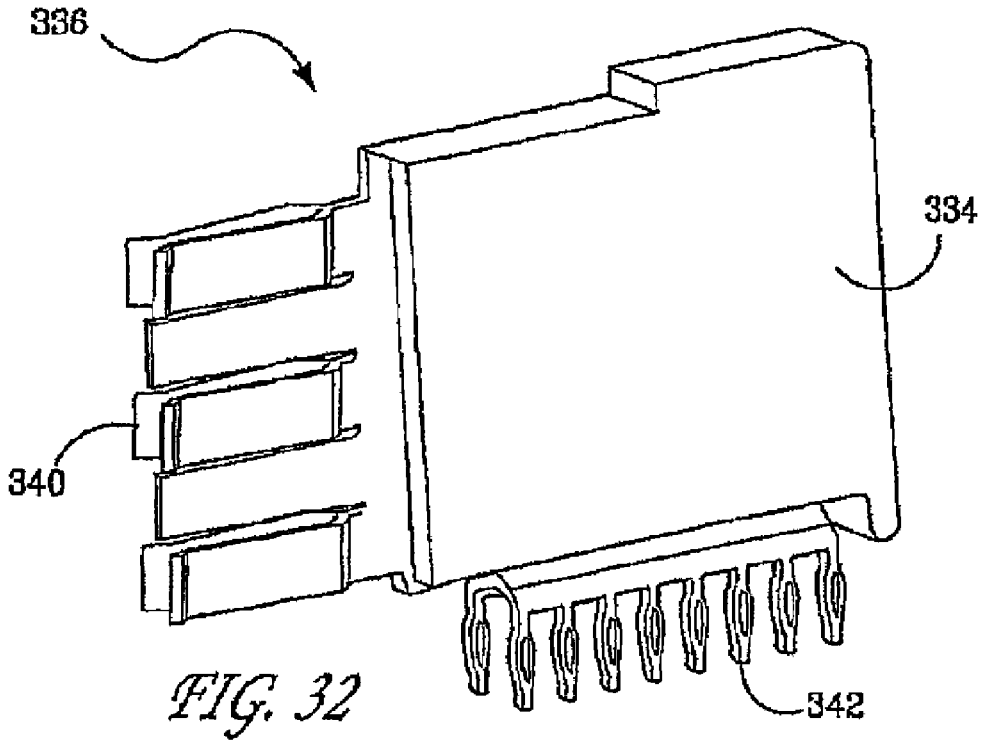
FIG. 32 is a perspective view of a power contact subassembly that has been separated from the strips of material shown in FIG. 31.
Figure 33:
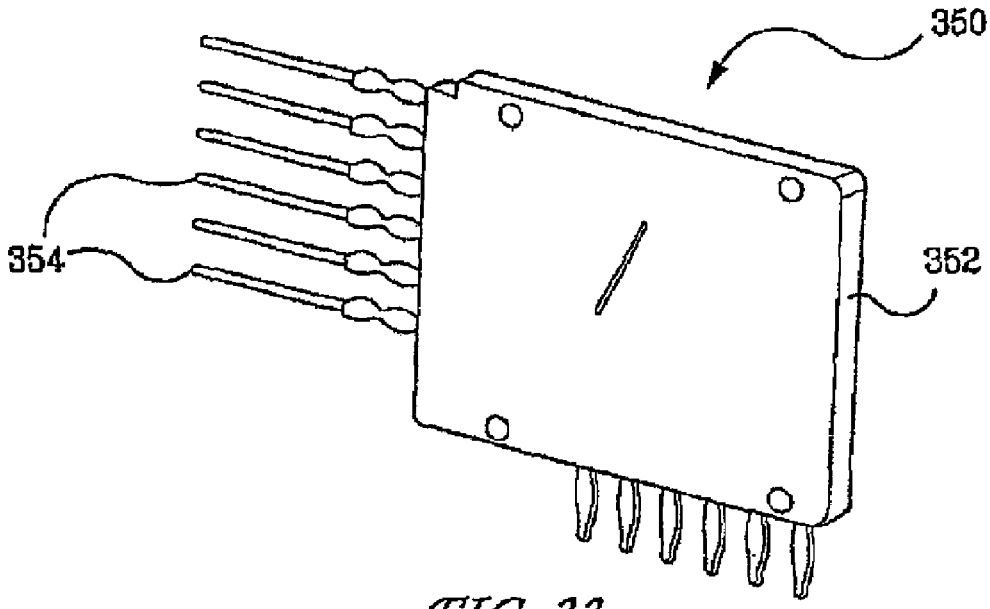
FIG. 33 is a perspective view of a signal contact subassembly in accordance with the present invention.

Individual contact elements can be separated from the remaining structure of strips 330 and 332, and then inserted into connector housings. In an alternative technique, the strips can be stacked together and then placed into a mold for creating overmolded contact subassemblies. A single strip could also be used where a contact employs only a single body member. And more than two strips could be stacked and be overmolded. Suitable thermoplastic material is flowed and solidified around a majority of the stacked body members to form a plastic casing 334, as is shown in FIG. 31. The contact subassembly 336 is then separated from the strips, as can be seen in FIG. 32. Beams 340 extend from casing 334 to engage a mating power contact, and terminals 342 extend from casing 334 for attaching the overmolded contact to a printed circuit structure. Signal contact subassemblies can also be made by overmolding a series of signal contacts, either in a strip form or individually. For example, an overmolded signal contact subassembly 350 is shown in FIG. 33, including a casing 352 and a series of signal contacts 354. FIG. 34 shows an exemplary electrical connector 360 having a housing 362, two power contact subassemblies 336 and multiple signal contact subassemblies 350.

Power and signal contacts of the present invention are made from suitable materials known to the skilled artisan, such as, for example, copper alloys. The contacts may be plated with various materials including, for example, gold, or a combination of gold and nickel. The number of contacts and their arrangement in connector housings is not limited to that shown in the figures. Some of the preferred power contacts of the present invention comprise plate-like body members stacked against each other. Stacking the body members allows a connector to carry extra current because of the added cross sectional area (lower resistance) and has the potential for added surface area that can facilitate convective heat transfer. One of ordinary skill in the art would readily appreciate that the plate-like body members may be planar or non-planar in form. The present invention also includes juxtaposing plate-like body members, such that the body members are spaced apart to define a medial space therebetween. The medial space can also enhance heat transfer, predominantly via convection. The contact plate-like body members may also contain apertures or other heat transfer features. The housing units of electrical connectors provided by the present invention may also contain features for enhancing heat dissipation, such as, for example, channels extending from the exterior of the connector to an interior of the connector, and housing voids or gaps adjacent surface portions of the retained power contacts.

The number, positioning, and geometry of the cantilevered beams extending from the contacts is not limited to that shown in the figures. Some of the beam configurations discussed above have purported benefits; however, other beam configurations contemplated by the present invention may not have the same purported benefits.

FIGS. 36 and 38-39G depict an alternative embodiment in the form of a power contact 500. The power contact 500 can mate with another power contact 550 depicted in FIGS. 37-39G.

The power contact 500 comprises a first half 502 and a second half 504. The first half 502 includes a plate-like body member 506*a*. The second half 504 includes a plate-like body member 506*b*. The body members 506*a*, 506*b* oppose, or face each other, and are stacked against each other as shown in FIGS. 4 and 5. The body members 506*a*, 506*b* can be spaced apart along a portion or an entirety thereof in alternative embodiments of the power contact 500.

Figure 36:
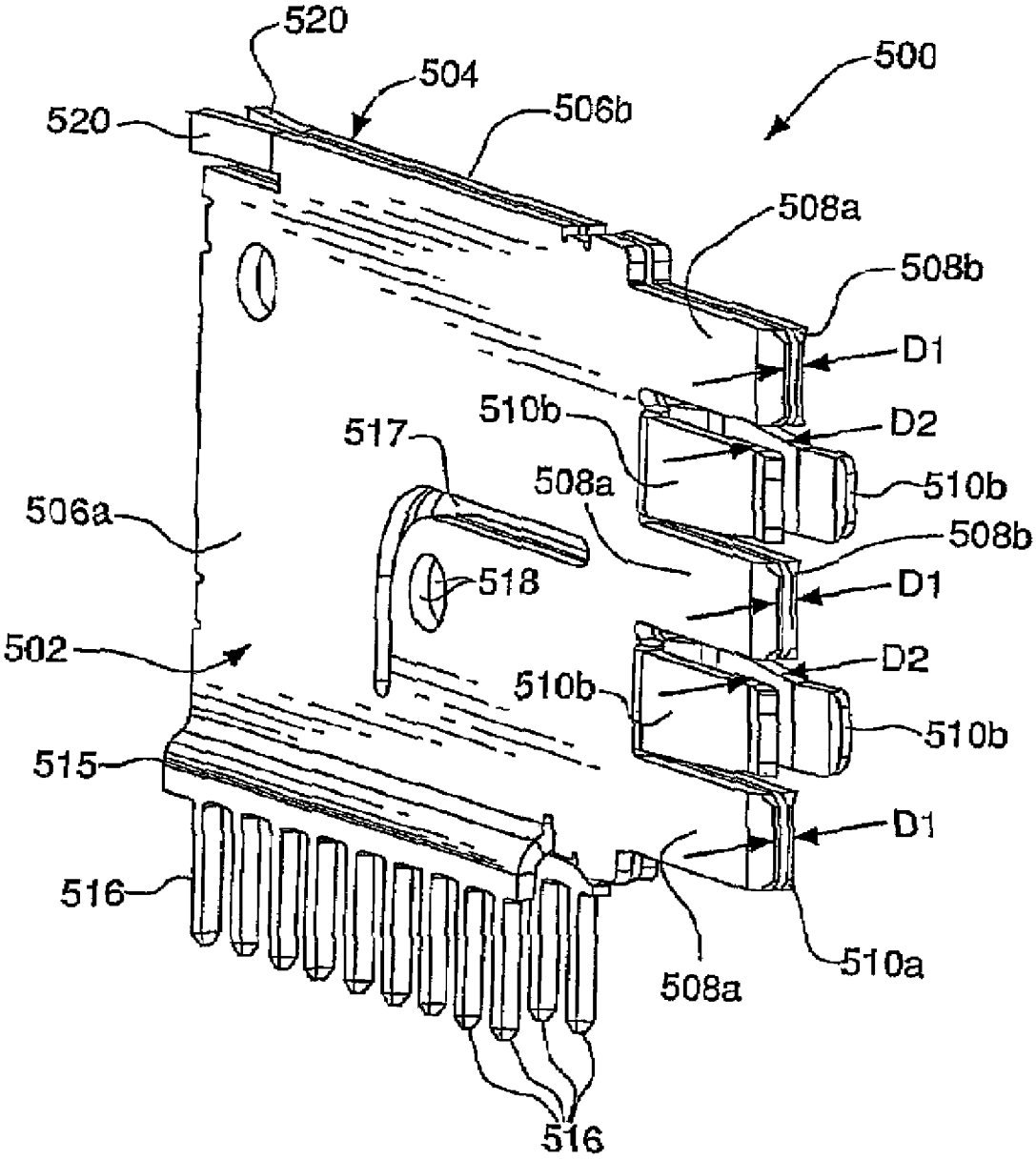
FIG. 36 is a perspective view of an exemplary power contact having deflectable pinched contact beams.

The first portion 502 includes three contact beams of a first type. The first type of contact beams can be substantially straight contact beams 508*a*, as shown in FIG. 36. Each straight contact beam 508*a* adjoins a forward end of the body member 506*a*, from the perspective of FIG. 36. A forward edge of each straight contact beam 508*a* is preferably rounded or curved, shown in FIG. 38.

The first portion 502 further includes two contact beams of a second type. The second type of contact beams can be angled contact beams 510*a*, as shown in FIG. 36. Each angled contact beam 510*a* adjoins the forward end of the body member 506*a*.

Figure 38:
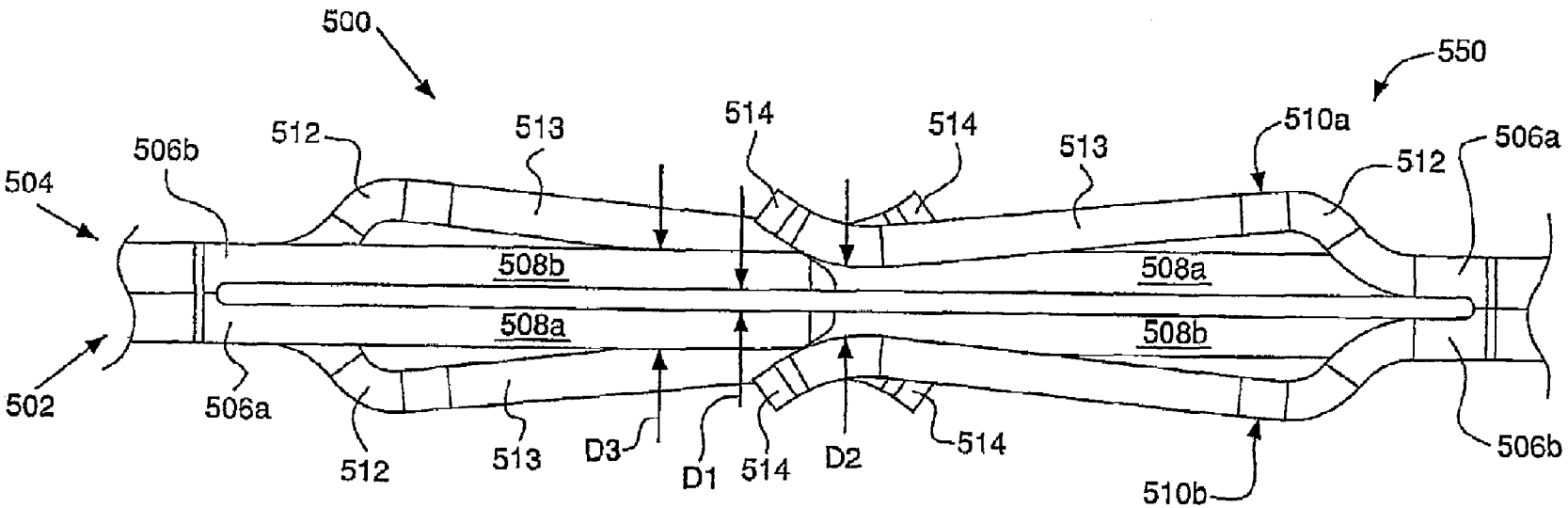
FIG. 38 is a top view of the power contacts shown in FIGS. 36 and 37, at the start of a mating sequence thereof.

Each angled contact beam 510*a* can include a substantially S-shaped portion 512 that adjoins the forward end of the body member 506*a*, as shown in FIG. 38. Each angled contact beam 510*a* can also include a straight portion 513 that adjoins the associated angled portion 112, and a curved portion 514 that adjoins the straight portion 513. This configuration causes each of the angled contact beams 510*a* to extend outwardly and then inwardly along a length thereof.

The second portion 504 includes three of the first type of contact beams in the form of substantially straight contact beams 508*b*. The straight contact beams 508*b* each adjoin a forward end of the body member 506*b*.

Each straight contact beam 508*a* faces, and is spaced apart from an associated straight contact beam 508*b* when the contacts beams 508*a*, 508*b* are in an unmated, un-deflected state, so that each pair of associated straight contact beams 508*a*, 508*b* is separated by a gap. This gap is denoted by the reference character "D1" in FIGS. 36 and 38.

The second portion 504 also includes two of the second type of contact beams in the form of angled contact beams 510*b*. The angled contact beams 510*b* each adjoin the forward end of the body member 506*b*.

Each angled contact beam 510*a* faces, and is spaced apart from an associated straight contact beam 510*b* when the angled contacts beams 510*a*, 510*b* are in an unmated, un-deflected state, so that the curved portions 514 of each pair of associated angled contact beams 510*a*, 510*b* are separated by a gap. This gap is denoted by the reference character "D2" in FIGS. 36 and 38. The gap D2 is less than the combined width of the power contacts 508*a*, 508*b*, plus the gap D1, i.e., the gap D2 is less than the distance between the outwardly-facing major surfaces of the straight contact beams 508*a*, 508*b*. The combined width of the power contacts 508*a*, 508*b*, plus the gap D1 is denote b the reference character "D3" in FIGS. 37 and 38.

The optimal values for the gaps D1 and D2 are application dependent, and can vary with factors such as the desired insertion, or mating force required to mate power contacts 500, 500*a*, the desired footprint of the power contacts 500, 550, etc. Specific values for the gaps D1 and D2 therefore are not provided herein.

Each pair of associated straight contact beams 508*a*, 508*b* can have a length that is different than that of the other pairs of associated straight contact beams 508*a*, 508*b*. For example, the uppermost pair of straight contact beams 508*a*, 508*b* can have a first length. The lowermost pair of straight contact beams 508*a*, 508*b* can have a second length that is less than the first length. The intermediate pair of straight contact beams 508*a*, 508*b*, i.e., the pair of straight contact beams 508*a*, 508*b* located between the uppermost and lowermost pairs, can have a third length that is less than the first length and greater than the second length. These features can help to reduce the insertion force associated with the power contacts 500, 550. The straight contact beams 508*a*, 508*b* are shown in FIG. 36 as having equal lengths, for clarity of illustration.

The first and second halves 502, 504 of the power contact 500 are each depicted with three straight contact beams 508*a* or 508*b*, and two angled contact beams 510*a* or 510*b* for exemplary purposes only. Alternative embodiments of the power contact 500 can include first and second halves 502, 504 having any number of the straight contact beams 508*a*, 508*b* and angled contact beams 510*a*, 510*b*, including a single straight contact beam 508*a*, 508*b* and/or a single angled contact beam 510*a*, 510*b*.

The straight contact beams 508*a* and the angled contact beams 510*a* of the first half 502 are preferably arranged on the body member 506*a* in an alternating manner, i.e., each angled contact beam 510*a* is positioned adjacent to, and between two straight contact beams 508*a* as shown in FIG. 36. The straight contact beams 508*b* and the angled contact beams 510*b* of the second half 504 are preferably arranged on the body member 506*b* in an alternating manner.

Each of the first and second halves 502, 504 preferably includes a substantially S-shaped portion 515 that adjoins a bottom edge of the body member 506*a*, 506*b*, as shown in FIG. 36.

Each of the first and second halves 502, 504 also includes a plurality of terminal pins 516 that adjoin an associated one of the substantially S-shaped portions 515. The terminal pins 516 can be received in plated through holes or other features of the substrate on which the power contact 500 is mounted, establish electrical and mechanical contact between the power contact 500 and the substrate. The substantially S-shaped portions 515 each jog or flare outwardly in relation to their associated body member 506*a*, 506*b*, to provide an offset between the terminal pins 516 of the first half 502 and the terminal pins 516 of the second half 504.

The power contact 500 is depicted as a right angle contact for exemplary purposes only. Alternative embodiments of the power contact 500 can be configured with the terminal portions 515 extending directly or indirectly from a rearward edge of the associated body member 506*a*, 506*b*.

Each of the body members 506*a*, 506*b* can include current-guiding features, such as a slot 517 shown in FIG. 36, to encourage even distribution of the electrical current flowing through the power contact 500 during operation thereof. Alternative embodiments of the power contact 500 can be formed without current-guiding features.

One or both of the body members 506*a*, 506*b* can include one or more projections 518. The projections 518 can be received in through holes formed in the other body member 506*a*, 506*b*, to help maintain the first and second halves 502, 504 in a state of alignment as the power contact 500 is inserted into its housing. Alternative embodiments of the power contact 500 can be formed without such alignment features.

Each body member 506*a*, 506*b* can include a tab 520 located at an upper rearward corner thereof. The tab 520 is angled outward, as shown in FIG. 36. Each tab 520 can contact an associated lip (not shown) on the housing of the power contact 500 as the power contact 500 is inserted into the housing from the rearward side thereof. Contact between the tab 520 and the lip causes the tab 520 to deflect inward. The tab 520 clears the lip as the power contact 500 approaches its fully-inserted position within the housing. The resilience of the tab 520 causes the tab 520 to spring outward, to its original position, once the tab 520 clears the lip. Interference between the tab 520 the lip can discourage the power contact 500 from backing out of the housing.

The power contact 550 is substantially identical to the power contact 500, with the exception of the numbers and relative locations of the straight contact beams 508*a*, 508*b* and the angled contact beams 510*a*, 510*b*. Substantially identical components of the power contacts 500, 500*a* are identified by identical reference characters in the figures.

Figure 37:
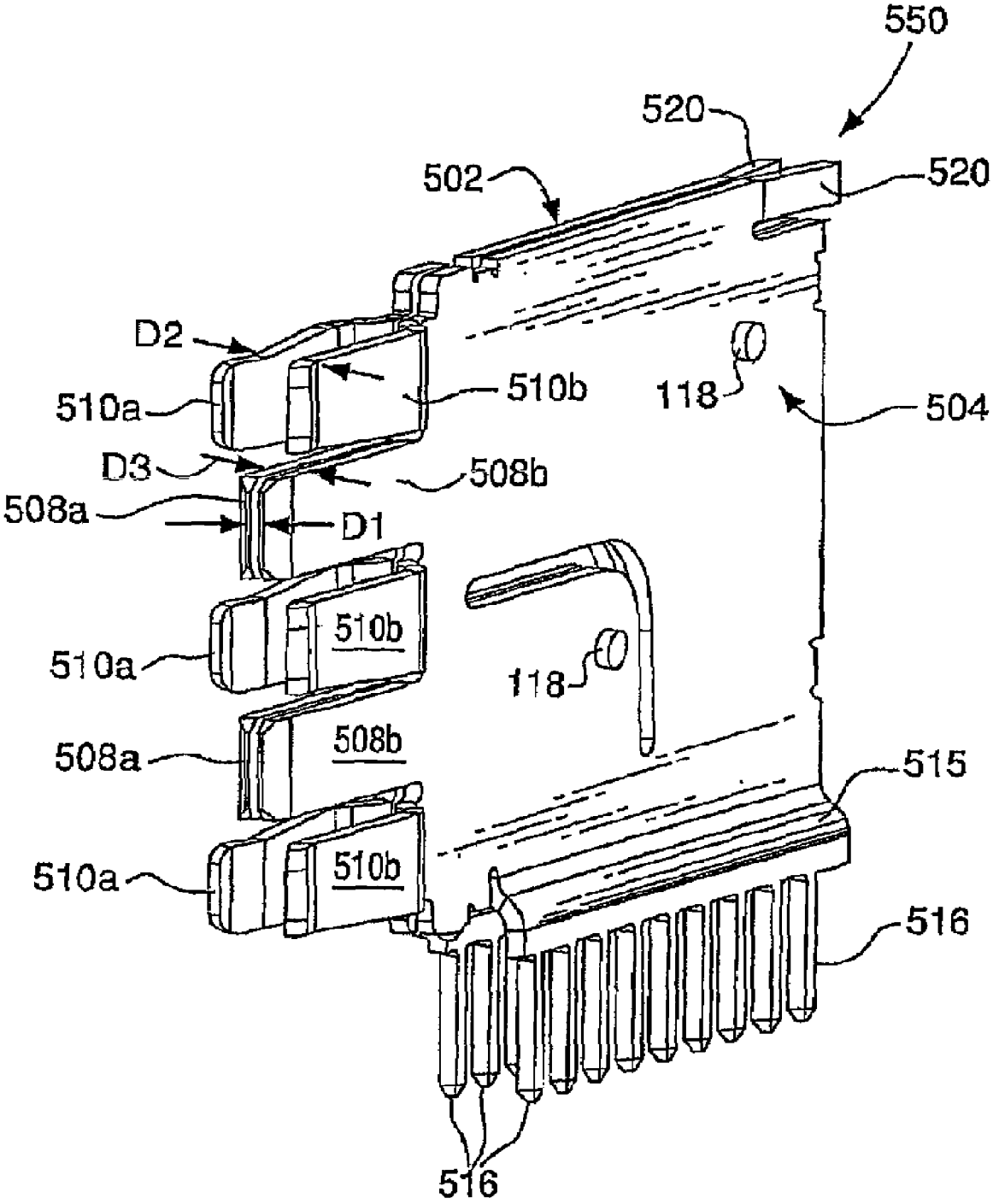
FIG. 37 is a perspective view of a power contact capable of mating with the power contact shown in FIG. 36.

The first portion 502 of the power contact 550 includes two of the substantially straight contact beams 508*a* that each adjoin a forward end of the body member 506*a*, as shown in FIG. 37. The second portion 504 includes two of the substantially straight contact beams 508*b* that each adjoin a forward end of the body member 506*b*. Each straight contact beam 508*a* faces an associated straight contact beam 508*b*, and is spaced apart from the associated straight contact beam 508*b* by a gap approximately equal to the gap D1.

Each pair of associated straight contact beams 508*a*, 508*b* of the power contact 550 can have a length that is different from that of the other pair of straight contact beams 508*a*, 508*b*. For example, the uppermost pair of straight contact beams 508*a*, 508*b* can have a length that is approximately equal of the third length associated with length of the intermediate pair of straight contact beams 508*a*, 508*b* of the power contact 500. The lowermost pair of straight contact beams 508*a*, 508*b* of the power contact 550 can have a length that is approximately equal to the second length associated with the length of the lowermost pair of straight contact beams 508*a*, 508*b* of the power contact 500.

The first portion 502 of the power contact 550 further includes three of the angled contact beams 510*a* that each adjoin the forward end of the body member 506*a*. The second portion 504 of the power contact 550 further includes two of the angled contact beams 510*b* that each adjoin the forward end of the body member 506*b*. Each angled contact beam 510*a* faces an associated contact beam 510*b*, and is spaced apart from the associated angled contact beam 510*b* by a gap approximately equal to the gap D2.

The straight contact beams 508*a* and the angled contact beams 510*a* of the first half 502 of the power contact 550 are arranged on the body member 506*a* in an alternating manner, so that each straight contact beam 508*a* is positioned adjacent to, and between two angled contact beams 510*a*, as shown in FIG. 37. The straight contact beams 508*b* and the angled contact beams 510*b* of the second half 504 of the power contact 550 are likewise arranged on the body member 506*b* in an alternating manner.

The above-noted configuration of the power contact 550 permits each pair of straight contact beams 508*a*, 508*b* of the power contact 550 to engage an associated pair of angled contact beams 510*a*, 510*b* of the power contact 500 when the power contacts 500, 550 are mated. In addition, each pair of angled contact beams 510*a*, 510*b* of the power contact 550 engages an associated pair of straight contact beams 508*a*, 508*b* of the power contact 500 when the power contacts 500, 550 are mated.

The mating sequence for the power contacts 500, 550 is depicted in FIGS. 39A-39G. The power contacts 500, 550 are initially positioned so that each pair of straight contact beams 508*a*, 508*b* of the power contact 500 substantially aligns with an associated pair of angled contact beams 510*a*, 510*b* of the power contact 550. In addition, each pair of angled contact beams 510*a*, 510*b* of the power contact 500 substantially aligns with an associated pair of straight contact beams 508*a*, 508*b* of the power contact 550.

Figure 39C:
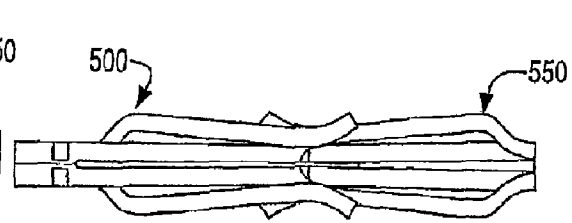
FIGS. 39A-39G are top views of the power contacts shown in FIGS. 36-38 throughout the mating sequence thereof.
Figure 39B:
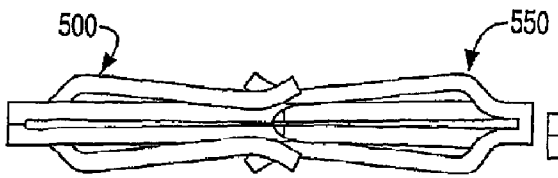
Figure 39A:
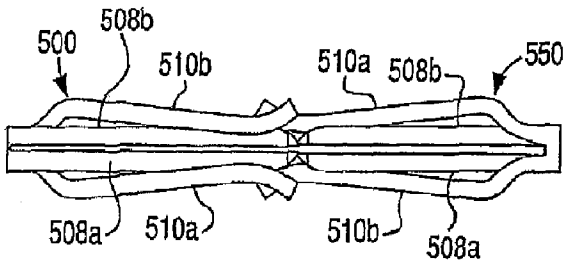
Figure 39F:
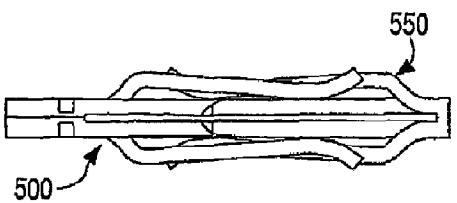
Figure 39E:
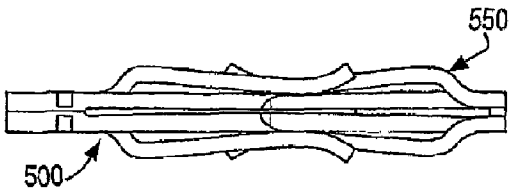
Figure 39D:
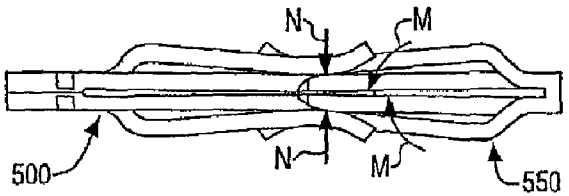

Movement of the aligned power contacts 500, 550 toward each other causes the leading edges of the uppermost, or longest contact beams 508*a*, 508*b* of the power contact 500 to contact the associated angled contact beams 510*a*, 510*b* of the power contact 550, and to enter the gap D2 between the angled contact beams 510*a*, 510*b*. This point in the mating sequence is shown in FIGS. 38 and 39A.

The gap D2 is less than the combined width of the power contacts 508*a*, 508*b*, plus the gap D1, i.e., the gap D2 is less than the distance D3. Continued movement of the power contacts 500, 550 toward each other therefore causes the curved portions 514 of the angled contact beams 510*a*, 510*b* to exert an inwardly acting normal, or contact force on the straight contact beams 508*a*, 508*b*. The normal forces are denoted by the reference symbol "N," and are depicted only in FIG. 39D, for clarity. The normal forces N cause the straight contact beams 508*a*, 508*b* to deflect inwardly, i.e., toward each other, as depicted in FIG. 39C.

The normal forces N that are required to deflect, or pinch the straight contact beams 508*a*, 508*b* inwardly causes the insertion force to rise at this point. The insertion force decreases once the straight contact beams 508*a*, 508*b* have reached the extent of their inward deflection, as the insertion force immediately following that point is due primarily to friction between the straight contact beams 508*a*, 508*b* and the contacting angled contact beams 510*a*, 510*b*.

The insertion force rises again as the straight contact beams 508*a*, 508*b* of the power contacts 500, 550 having the intermediate, or third length contact the associated angled contact beams 510*a*, 510*b*. This contact, in combination with the continued movement of the power contacts 500, 550 toward each other, causes the intermediate-length straight contact beams 508*a*, 508*b* to deflect inwardly. The insertion force decreases after the straight contact beams 508*a*, 508*b* reach the extent of their inward deflection, as discussed above in relation to the uppermost straight contact beams 508*a*, 508*b*.

The insertion force rises again as the straight contact beams 508*a*, 508*b* of the power contacts 500, 550 having the shortest, or second length contact the associated angled contact beams 510*a*, 510*b*, and decreases after the straight contact beams 500*a*, 508*b* reach the extent of their inward deflection.

The ability of the straight contact beams 508*a*, 508*b* to deflect inwardly when pinched by the associated angled contact beams 510*a*, 510*b* is believed to reduce the insertion force required to mate the power contacts 500, 550, in relation to a comparable set of power contacts in which the pinched beams do not deflect. More specifically, the inward deflection of the straight contact beams 508*a*, 508*b* during their initial stage of mating obviates the need for the angled contact beams 510*a*, 510*b* to deflect outwardly to slide over the associated straight contact beams 508*a*, 508*b*.

A relatively small amount of insertion force is initially needed to cause the straight contact beams 508*a*, 508*b* to deflect inwardly. In particular, the angled contact beams 510*a*, 510*b* contact the leading edges of the respective straight contact beams 508*a*, 508*b* at the start of the mating sequence. The straight contact beams 508*a*, 508*b* are restrained from their respective rearward ends. The relatively large distance, or moment arm, between the points at which the normal forces are applied and the points of restraint cause the normal forces N to generate relatively large moments on the straight contact beams 508*a*, 508*b* at the start of the mating sequence. These moments cause the leading edges of the straight contact beams 508*a*, 508*b* to deflect inwardly when the normal forces N, and the insertion forces that give rise the normal forces, are relatively low. The moments acting on the straight contact beams 508*a*, 508*b* are denoted by the reference symbol "M," and are depicted only in FIG. 39D, for clarity.

The initial insertion force therefore does not have to be applied toward spreading the angled contact beams 510*a*, 510*b* so that angled contact beams 510*a*, 510*b* can slide over the straight contact beams 508*a*, 508*b*. It is believed that pinching the straight contact beams 510*a*, 510*b* inward, rather than spreading the angled contact beams 510*a*, 510*b* outward, can reduce the insertion force at the start of the mating sequence, in comparison to a set of power contacts in which the pinched beams to not deflect.

The straight contact beams 508*a*, 508*b* can return to their approximate un-deflected, i.e., original, positions as the power contacts 500, 550 approach their fully-mated state. More particularly, the points of contact between the angled contact beams 510*a*, 510*b* and the associated straight contact beams 508*a*, 508*b* move toward the rear of the straight contact beams 508*a*, 508*b* as the power contacts 500, 550 are mated, as shown in FIGS. 39A-39G. The distance between the points at which the contact forces N are applied to the straight contact beams 508*a*, 508*b*, and the point of restraint of the straight contact beam 508*a*, 508*b* therefore decrease as the mating sequence progresses, i.e., the length of the moment arm associated with each of the normal forces N decreases as the mating sequence progresses. The resulting moments M exerted on the straight contact beams 508*a*, 508*b* decrease correspondingly.

Figure 39G:
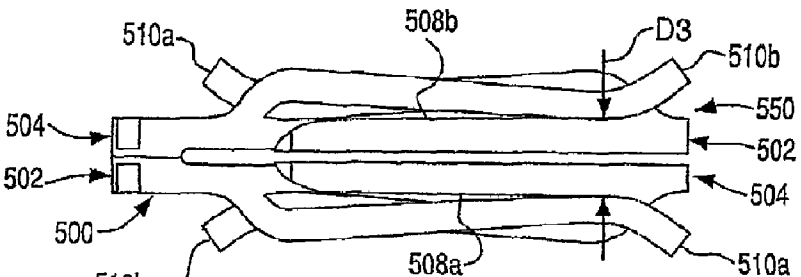

The restoring forces and moments generated by the resilience of the straight contact beams 508*a*, 508*b* eventually overcome the normal forces N and the associated moments M that initially caused the straight contact beams 508*a*, 508*b* to deflect inwardly. This point occurs as the power contacts 500, 550 approach their fully mated state. The straight contacts 508*a*, 508*b* return to their approximate un-deflected positions at this point, as shown in FIG. 39G.

The return of the straight contact beams 508*a*, 508*b* to their approximate un-deflected positions causes the angled contact beams 510*a*, 510*b* to deflect outwardly, thereby increasing the normal forces N between the straight contact beams 508*a*, 508*b* and the angled contact beams 510*a*, 510*b*. More particularly, the substantially un-deflected straight beams 508*a*, 508*b* at this point have spread the angled contact beams 510*a*, 510*b* to their maximum separation distance, which is approximately equal to the distance D3, as shown in FIG. 39G. The resulting normal forces N therefore are at their respective maximums at this point. Increasing the normal forces N can enhance the electrical and mechanical contact between the power contacts 500, 550 when the power contacts 500, 550 are fully mated.

Moreover, the configuration of the straight contact beams 508*a*, 508*b* is believed to cause the normal forces N, and the resulting insertion force, to increase smoothly and gradually as the mating sequence progresses. In particular, the inward deflection of each straight contact beam 508*a*, 508*b* causes the straight contact beam 508*a*, 508*b* to assume an angled orientation in relation to the direction of mating. The curved portion 514 of each angled contact beam 510*a*, 510*b* therefore rides up the mating surface of the associated straight contact beam 508*a*, 508*b* in a manner that spreads the angled contact beams 510*a*, 510*b* outwardly in a smooth and gradual manner. By contrast, the angled contact beams 510*a*, 510*b* would need to deflect suddenly and to their maximum extent at the start of the mating sequence, when mating with pinched contact beams that do not deflect inwardly.

Figure 40:
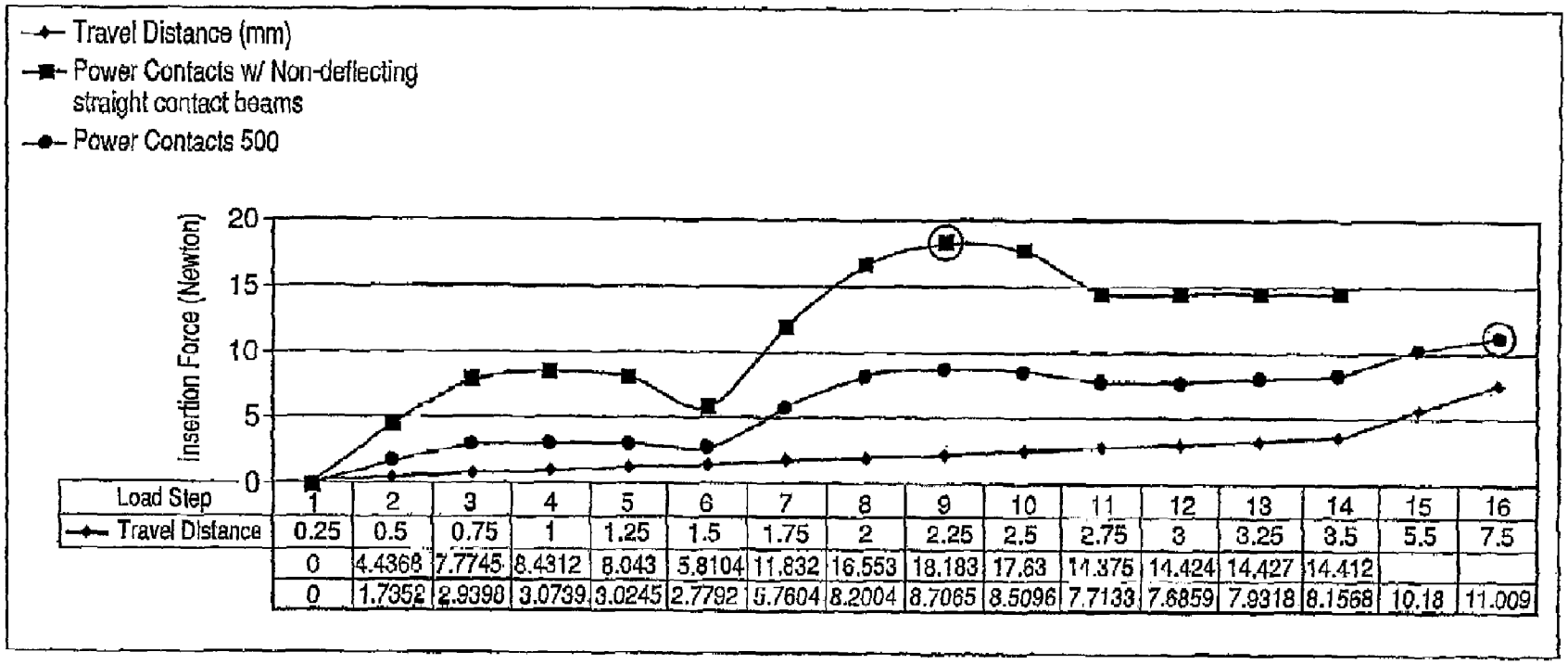
FIG. 40 is a graphical representation of the mating force associated with the power contacts shown in FIGS. 36-39G, throughout the mating sequence thereof; and the mating force associated with a pair of substantially similar power contacts having non-deflectable pinched beams.

It is believed that the ability of the straight contact beams 508*a*, 508*b* to inwardly deflect when pinched by the angled contact beams 510*a*, 510*b* can substantially reduce the insertion force needed to mate the power contacts 500, 550. For example, FIG. 40 depicts a theoretical predication of the insertion forces associated with the uppermost straight contact beams 508*a*, 508*b* and angled contact beams 510*a*, 510*b* during mating of the power contacts 500, 550. The load steps denoted in FIG. 40 correspond to those denoted in FIGS. 39A-39G.

FIG. 40 also depicts the insertion forces associated with the uppermost contact beams of a second pair of power contacts substantially similar to the power contacts 500, 550, with the exception that the pinched, or straight beams of the second pair of contacts do not deflect during mating. As shown in FIG. 40, the force required to mate the power contacts 500, 550 is approximately forty percent lower than the force required to mate the second pair of contacts.

The first type of contact beams of the power contact 500 are depicted as straight contact beams 508*a*, 508*b* for exemplary purposes only. The first type of contact beams can have a configuration other than straight in alternative embodiments. For example, the first type of contact beams can have an arcuate shape in the lengthwise direction thereof, or other shapes that permit the first type of contact beams to deflect inwardly during mating.

Figure 41A:
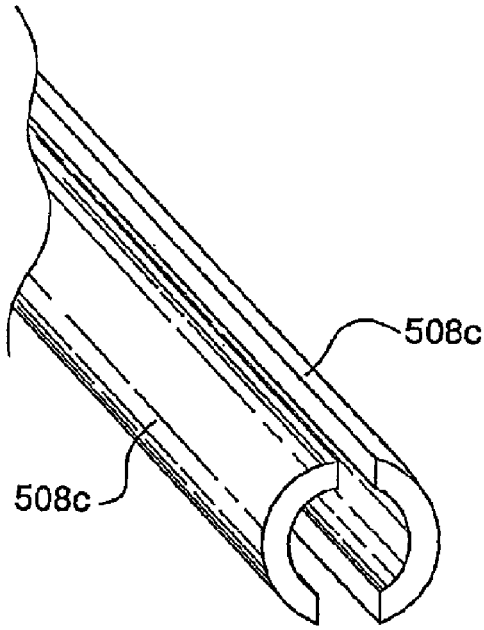
FIG. 41A is a front perspective view of two deflectable contact beams of an alternative embodiment of the power contacts shown in FIGS. 36-39G.
Figure 41B:
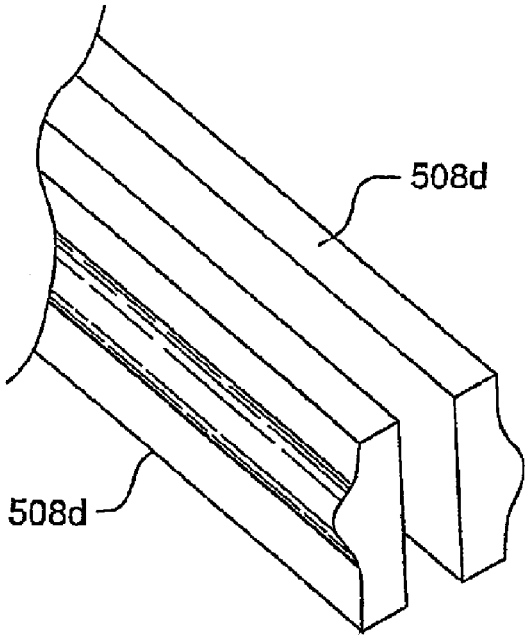
FIG. 41B is a front perspective view of two deflectable contact beams of another alternative embodiment of the power contacts shown in FIGS. 36-39G.

Moreover, the straight contact beams 508*a*, 508*b* are depicted as having a rectangular transverse cross section for exemplary purposes only. The first type of contact beams 508*a*, 508*b* of alternative embodiments can have transverse cross sections other than rectangular. For example, FIG. 41A depicts contact beams 508*c* having an arcuate transverse cross-section. FIG. 41B depicts contact beams 508*e* having a thickness that varies along the height of the contact beams 508*e*. Contact beams having other type of transverse cross sections can be used in other alternative embodiments. Moreover, the angled contact beams 510*a*, 510*b* can also be formed with cross sections other than rectangular in alternative embodiments.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed:

1. A power contact, comprising:

a first half comprising a first plate-like body member, a first substantially straight contact beam electrically and mechanically connected to the first body member, and a first angled contact beam electrically and mechanically connected to the first body member; and a second half comprising a second plate-like body member; a second substantially straight contact beam electrically and mechanically connected to the second body member and at least partially spaced apart from the first substantially straight contact beam by a first gap when the power contact is in an unmated state; and a second angled contact beam electrically and mechanically connected to the second body member and at least partially spaced apart from the first angled contact beam by a second gap when the power contact is in the unmated state.

2. The power contact of claim 1, wherein the second substantially straight contact beam is entirely spaced apart from the first substantially straight contact beam when the power contact is in the unmated state.

3. The power contact of claim 1, wherein the second gap is less than a combined width of the first substantially straight contact beam and the second substantially straight contact beam, plus the first gap.

4. The power contact of claim 1, wherein the first substantially straight contact beam and the second substantially straight contact beam can be pinched together as the power contact is mated with a mating contact.

5. The power contact of claim 1, wherein the angled contact beams each comprise an S-shaped portion that adjoins the first or the second body members, a straight portion that adjoins the S-shaped portion, and a curved portion that adjoins the straight portion.

6. The power contact of claim 1, wherein the first and second substantially straight contact beams each comprise an outwardly-facing mating surface, and the first and second angled contact beams each comprise an inwardly-facing mating surface.

7. The power contact of claim 1, wherein the first and second substantially straight contact beams are for deflecting toward each other as the power contact is mated with a mating contact, and the first and second angled contact beams are for deflecting away from each other as the power contact is mated with the mating contact.

8. A power contact, comprising:

a first contact beam having a mating surface, and a major surface located on an opposite side of the first contact beam from the mating surface;

a second contact beam having a mating surface, and a major surface located on an opposite side of the second contact beam from the mating surface of the second contact beam, the major surface of the second contact beam being at least partially spaced apart from the major surface of the first contact beam when the power contact is in an unmated state whereby the first and second contact beams can deflect toward each other as the power contact is mated;

a third contact beam having a mating surface; and a fourth contact beam having a mating surface that faces the mating surface of the third contact beam.

9. The power contact of claim 8, wherein the first and second contact beams are substantially straight contact beams, and the third and fourth contact beams are angled contact beams.

10. The power contact of claim 8, further comprising:

a first half comprising a plate-like body member mechanically and electrically connected to the first and third contact beams; and a second half comprising a plate-like body member mechanically and electrically connected to the second and fourth contact beams.

11. The power contact of claim 8, wherein:

a spacing between the first and second contact beams when the power contact is in a mated condition is less than a spacing between the first and second contact beams when the power contact is in an unmated condition; and a spacing between the third and fourth contact beams when the power contact is in the mated condition is greater than a spacing between the third and fourth contact beams when the power contact is in the unmated condition.

12. The power contact of claim 8, wherein the mating surface of the third contact beam is spaced from the mating surface of the fourth contact beam by a first distance when the power contact is in an unmated state, and the mating surface of the first contact beam is spaced from the mating surface of the second contact beam by a second distance when the power contact is in the unmated state, the second distance being greater than the first distance.

13. A connector system, comprising:

a first power contact comprising a first contact beam and an opposing second contact beam, at least a portion of the second contact beam being spaced apart from the first contact beam when the first and second power contacts are in an unmated state; and a second power contact matable with the first power contact, the second power contact comprising a third and an opposing fourth contact beam, wherein the third and fourth contact beams are for pinching the first and second contact beams and are for causing the first and second contact beams to deflect toward each other as the first and second power contacts are mated.

14. The connector system of claim 13, wherein the third and fourth contact beams are for deflecting away from each other as the first and second contacts are mated.

15. The connector system of claim 13, wherein the first and second contact beams are separated by a first gap and the third and fourth contact beams are separated by a second gap when the first and second power contacts are in an un-mated state, and the second gap is less than a combined width of the first and second contact beams plus the first gap.

16. The connector system of claim 13, wherein the first and second contact beams are for deflecting inwardly and then outwardly as the first and second power contacts are mated.

17. The connector system of claim 16, wherein the first and second contact beams are for deflecting outwardly for causing the third and fourth contact beams to deflect outwardly.

18. The connector system of claim 13, wherein mating surfaces of the first and second contact beams face substantially opposite directions, mating surfaces of the third and fourth contact beams face each other, the mating surface of the first contact beam contacts the mating surface of the third contact beam when the first and second power contacts are mated, and the mating surface of the second contact beam contacts the mating surface of the fourth contact beam when the first and second power contacts are mated.

19. The connector system of claim 13, wherein the first and second contact beams are substantially straight contact beams and the third and fourth contact beams are angled contact beams.

20. A power contact, comprising:

a first half comprising a first plate-like body member, a first type of contact beam electrically and mechanically connected to the first body member, and a second type of contact beam electrically and mechanically connected to the first body member; and a second half comprising a second plate-like body member; another of the first type of contact beams electrically and mechanically connected to the second body member and at least partially spaced apart from the first type of contact beam of the first half by a first gap when the power contact is in an unmated state; and another of the a second type of contact beams electrically and mechanically connected to the second body member and at least partially spaced apart from the second type of contact beam of the first half by a second gap when the power contact is in the unmated state;

wherein the second gap is less than a combined width of the first type of contact beam of the first half, plus the first type of contact beam of the second half, plus the first gap.

21. The power contact of claim 20, wherein the first type of contact beam is a substantially straight contact beam, and the second type of contact beam is an angled contact beam.

22. The power contact of claim 20, wherein the first type of contact beam of the second half is entirely spaced apart from the first type of contact beam of the first half when the power contact is in the unmated state.

23. The power contact of claim 20, wherein the first type of contact beam of the first half and the first type of contact beam of the second half are for pinching together as the power contact is mated with a mating contact.

24. The power contact of claim 21, wherein the angled contact beams each comprise an S-shaped portion that adjoins the first or the second body members, a straight portion that adjoins the S-shaped portion, and a curved portion that adjoins the straight portion.

25. The power contact of claim 20, wherein the first type of contact beams each comprise an outwardly-facing mating surface, and the second type of contact beams each comprise an inwardly-facing mating surface.

26. The power contact of claim 20, wherein the first type of contact beams are for deflecting toward each other as the power contact is mated with a mating contact, and the second type of contact beams are for deflecting away from each other as the power contact is mated with the mating contact.

* * * * *